US008651031B1

(12) United States Patent
Pazhoor

(10) Patent No.: US 8,651,031 B1
(45) Date of Patent: Feb. 18, 2014

(54) MULTI-CONFIGURATION STACKABLE VOTING BOOTH

(71) Applicant: Mohamed S. Pazhoor, West Palm Beach, FL (US)

(72) Inventor: Mohamed S. Pazhoor, West Palm Beach, FL (US)

( * ) Notice: Subject to any disclaimer, the term of this patent is extended or adjusted under 35 U.S.C. 154(b) by 0 days.

(21) Appl. No.: 13/659,234

(22) Filed: Oct. 24, 2012

Related U.S. Application Data

(60) Provisional application No. 61/582,665, filed on Jan. 3, 2012.

(51) Int. Cl.
*A47B 3/00* (2006.01)
*A47B 9/20* (2006.01)

(52) U.S. Cl.
USPC ..... 108/115; 108/147.21; 108/116

(58) Field of Classification Search
USPC ..... 108/27, 115–135, 137–143, 147.21
See application file for complete search history.

(56) References Cited

U.S. PATENT DOCUMENTS 3,123,022 A * 3/1964 Huddleston ..... 108/129
3,620,587 A * 11/1971 Ahmann ..... 312/203
4,445,731 A * 5/1984 Ahmann ..... 312/258
4,712,757 A * 12/1987 Ahmann ..... 248/188
5,666,765 A * 9/1997 Sarner et al. ..... 52/36.1
6,125,772 A * 10/2000 Clements ..... 108/129
D603,183 S 11/2009 Abel et al.
D603,184 S 11/2009 Abel et al.
D603,621 S 11/2009 Abel et al.
D612,631 S 3/2010 Pazhoor
D616,217 S 5/2010 Abel et al.
D616,667 S 6/2010 Pazhoor
D616,668 S 6/2010 Pazhoor
D622,975 S 9/2010 Abel et al.
7,895,954 B2 3/2011 Abel et al.
2010/0065515 A1* 3/2010 DeLongchamp ..... 211/1.3

* cited by examiner

*Primary Examiner* — Darnell Jayne
*Assistant Examiner* — Timothy M Ayres
(74) *Attorney, Agent, or Firm* — Gold & Rizvi, P.A.; Glenn E. Gold

(57) ABSTRACT

A multi-configuration voting booth is disclosed which includes a voting tabletop assembly having a bottom cavity and a top surface. A plurality of support leg holders are movably coupled within the bottom cavity such that the holders may be positioned within the cavity or extending outward from the cavity. Coupled to the outward end of the holder is a telescopic support leg that is adjustable in length. The support leg is coupled to the holder such that the width of the space between the support legs may be adjusted to accommodate a wheelchair therein. A privacy panel assembly is provided that is foldably coupled to the top surface of the voting tabletop assembly. The voting tabletop assembly is configured for nesting two booths together to facilitate storage and transportation.

18 Claims, 22 Drawing Sheets

MULTI-CONFIGURATION STACKABLE VOTING BOOTH

CROSS-REFERENCE TO RELATED APPLICATION

This Non-Provisional Utility application claims the benefit of U.S. Provisional Patent Application Ser. No. 61/582,665, filed on Jan. 3, 2012, which is incorporated herein in its entirety.

FIELD OF THE INVENTION

The present disclosure generally relates to portable voting booths. More particularly, the present disclosure relates to a multi-configuration voting booth comprising a series of telescoping legs and a pivotal privacy shield that are moveably attached to a voting booth table, wherein the voting booth converts between a collapsed, stackable storage configuration, a standard deployed configuration, and a handicapped accessible configuration.

BACKGROUND OF THE INVENTION

During the voting process, there is an overwhelming basic requirement to provide privacy for the person voting while that person actually fills out a ballet or other confidential forms regarding the electoral process. Voter privacy is of critical importance in the election process to ensure that a voter has not been unduly influenced extraneous sources. It is common for an election to convert common public and/or private locations into polling locations by deploying a plurality of temporary voting booths. This enables a person the ability to exercise their right to vote for an individual running for a designated political office or other position of leadership, vote for their desired disposition of a proposed law, and the like at a convenient location. These polling locations are selected and temporarily configured to accommodate a large number of the voting public. Some examples of known polling places are public school gymnasiums, governmental meeting auditoriums and the like. A polling place traditionally had voting booths which provided a voting table surrounded by a privacy curtain supported by a framework, wherein the privacy curtain provides the voter with a basic level of privacy during the voting process. While this known solution to voter privacy is somewhat beneficial, there are a few drawbacks to this solution. A principle drawback is the time required to assembly and set up the actual framework of the voting booths. The increased time to construct this configuration of voting booths has proven problematic with the increased voting population, as more and more voting booths are required for each election. Another drawback to this known solution is the extra area required by the framework for each booth. This extra area/space consumption translates into less than optimal use of the floor space of the polling location. The voting booths are commonly fabricated of many separate components, thus increasing a potential of missing parts, complexity of storage, and time required for assembly.

Consequently, as the voting population has increased other types of compact and temporary voting booths have been developed. These newer voting booths provide some level of privacy and are generally portable and collapsible to some extent. However, when a polling location is being set up there are additional requirements that must be met to ensure the integrity of the electoral process. Of primary concern, is the provision for both handicapped and non-handicapped voters as required by the Americans with Disabilities Act (herein after referred to as the ADA). This act generally requires that special provisions and/or accommodations be provided for disabled or handicapped persons. Some examples of these provisions are ensuring a person in a wheelchair has access to specific areas by way of ramps instead of stairs. Providing counters, sinks, toilets that are located at a height that facilitates use by the handicapped person. In response to the ADA, there are numerous types of portable voting booths commercially available. However, these known solutions are generally distinctly and permanently configured as one of an ADA compliant device for use by handicapped voters or a standard/regular device for use by non-handicapped voters.

While these known solutions are somewhat useful, they present substantial drawbacks. The number of voting booths for each distinct form factor (one form factor for the handicapped and a second form factor for non-handicapped voters) needs to be determined well in advance of the voting date for adequate procurement. The requirement of two distinct voting booths increases the complexity and logistics of procuring, storing, and deploying the voting booths. Since the footprint of the handicapped configuration is larger than the footprint of the standard configuration, the layout becomes more complex. The overall voting booth layout at each election location needs to be considered when determining the total quantity of each of the voting booth configurations. An incorrect quantity of either voting booth configuration can cause issues when preparing a polling location. Finally, since there are two distinct devices, increased storage space is required to store the devices when not in use.

Efforts to provide a multi-configuration voting booth that overcomes the drawbacks in the prior art have not met with significant success to date. As a result, there is a need in the art for a multi-configurable, collapsible, stackable, and portable voting booth that facilitates deployment, storage, and transportation that can be efficiently used in the election process such that a voter may fill out/complete election forms in privacy. There is a further need for an improved voting both that is configurable for use both by unencumbered individuals as well as physically handicapped people.

SUMMARY OF THE INVENTION

The basic inventive concept provides a multi-configurable voting booth that converts between a collapsed, stackable storage configuration, a standard deployed configuration, and a handicapped accessible configuration. Additionally all components of the multi-configurable voting booth remain as a single, unified configurable assembly.

A first aspect of the present invention provides a multi-configurable voting booth comprising:

- a voting tabletop assembly having a top surface and a perimeter wall extending downward from a peripheral edge of the top surface, the perimeter wall and top surface collectively defining a bottom cavity;
- a plurality of support leg assemblies attached to the voting tabletop assembly, wherein the legs are configurable between a stored configuration locating each entire collapsed leg within the bottom cavity, a standard deployed configuration positioning the support leg assemblies at a first predetermined span and a first predetermined vertical dimension, and a handicapped configuration positioning the support leg assemblies at a second predetermined span and a second predetermined vertical dimension, wherein the second span is greater than the first span, and the first vertical dimension is greater than the second vertical dimension;

a privacy panel assembly including a rear panel defined by a lower edge, an upper edge, a first vertical edge, and a second vertical edge; a first side panel attached to the first rear panel vertical edge and a second side panel attached to the second rear panel vertical edge; and an interface retaining the privacy panel assembly and the voting tabletop assembly together, wherein the privacy panel assembly is configured extending upwards from a position proximate three sides of a perimeter of the voting tabletop assembly.

A second aspect of the present invention incorporates a first pivotal interface provided between the first side panel and the first rear panel vertical edge and a second pivotal interface provided between the second side panel and the second rear panel vertical edge.

In yet another aspect, the privacy panel assembly is pivotally attached to the voting tabletop assembly.

In yet another aspect, the privacy panel assembly can be collapsed into a storage configuration, where the storage configuration positions the privacy panel assembly into a parallel and flush arrangement respective to an upper surface of the voting tabletop assembly.

In yet another aspect, the telescoping legs are configured comprising a plurality of telescoping tubular members.

In yet another aspect, the telescoping legs are pivotally coupled to an underside of the voting tabletop assembly.

In yet another aspect, the telescoping legs are slideably coupled to an underside of the voting tabletop assembly.

In yet another aspect, the telescoping legs further comprise a biased member, a standard configuration mating feature and a handicapped configuration mating feature, wherein the biased member engages with the standard configuration mating feature to retain the legs at the predetermined standard configuration and the biased member engages with the handicapped configuration mating feature to retain the legs at the predetermined handicapped configuration.

In yet another aspect, the biased member is a spring biased pin and the mating feature is an aperture sized to receive the spring biased pin.

In yet another aspect, the telescoping legs are pivotally retained in a collapsed configuration by a storage retention feature.

In yet another aspect, the telescoping legs are pivotally retained in a deployed configuration by a deployment retention feature.

In yet another aspect, the deployment retention feature is a "C" shaped formation.

In yet another aspect, the deployment retention feature is a biased retention pin and pin receptacle combination.

In yet another aspect, each leg can comprise a telescoping section that is pivotally assembled to a sliding element. The sliding element slideably engages with a mating track, wherein the mating track is integrated into the bottom cavity.

In yet another aspect, the voting booth further comprises at least one handle formed in a voting tabletop assembly perimeter wall.

In yet another aspect, the voting booth further comprises at least one clip operatively attached to a first perimeter wall and a mating clip receptacle for each of the at least one clips formed within an opposite voting tabletop assembly perimeter wall, wherein each of the at least one clips of a first voting tabletop assembly removably engages with the respective mating clip receptacle of a second voting tabletop assembly.

In yet another aspect, each pair of voting table assemblies is arranged having exposed edges of the perimeter walls contacting one another.

In yet another aspect, the first privacy side panel is retained in position by inserting a first side panel tab extending from a lower edge thereof into a first respective slot provided within the voting tabletop assembly and the second privacy side panel is retained in position by inserting a second side panel tab extending from a lower edge thereof into a second respective slot provided within the voting tabletop assembly.

In yet another aspect, each leg deploys through a respective leg port located at each corner of the voting tabletop assembly.

In yet another aspect, each leg port is sealed by a leg port cover. The leg port cover can be pivotally attached to the voting tabletop assembly. The leg port cover can be retained in a sealed positioned by at least one snap feature.

In deployment, the voting booth assembly would be decoupled from a stack of voting booth assemblies. Each of a plurality of legs would be extended from a stored state within the bottom cavity through a leg port and secured in position. The legs would be extended in both a horizontal dimension to a predetermined span and a vertical dimension to a predetermined height via a telescoping interface to a desired standard or handicapped configuration. The privacy shield is deployed and assembled to the voting tabletop assembly. The readied voting booth is then placed in the desired location within the polling facility.

These and other advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, in which.

In the figures, like reference numerals designate corresponding elements throughout the different views of the drawings.

DETAILED DESCRIPTION OF THE PREFERRED EMBODIMENTS

Figure 1:
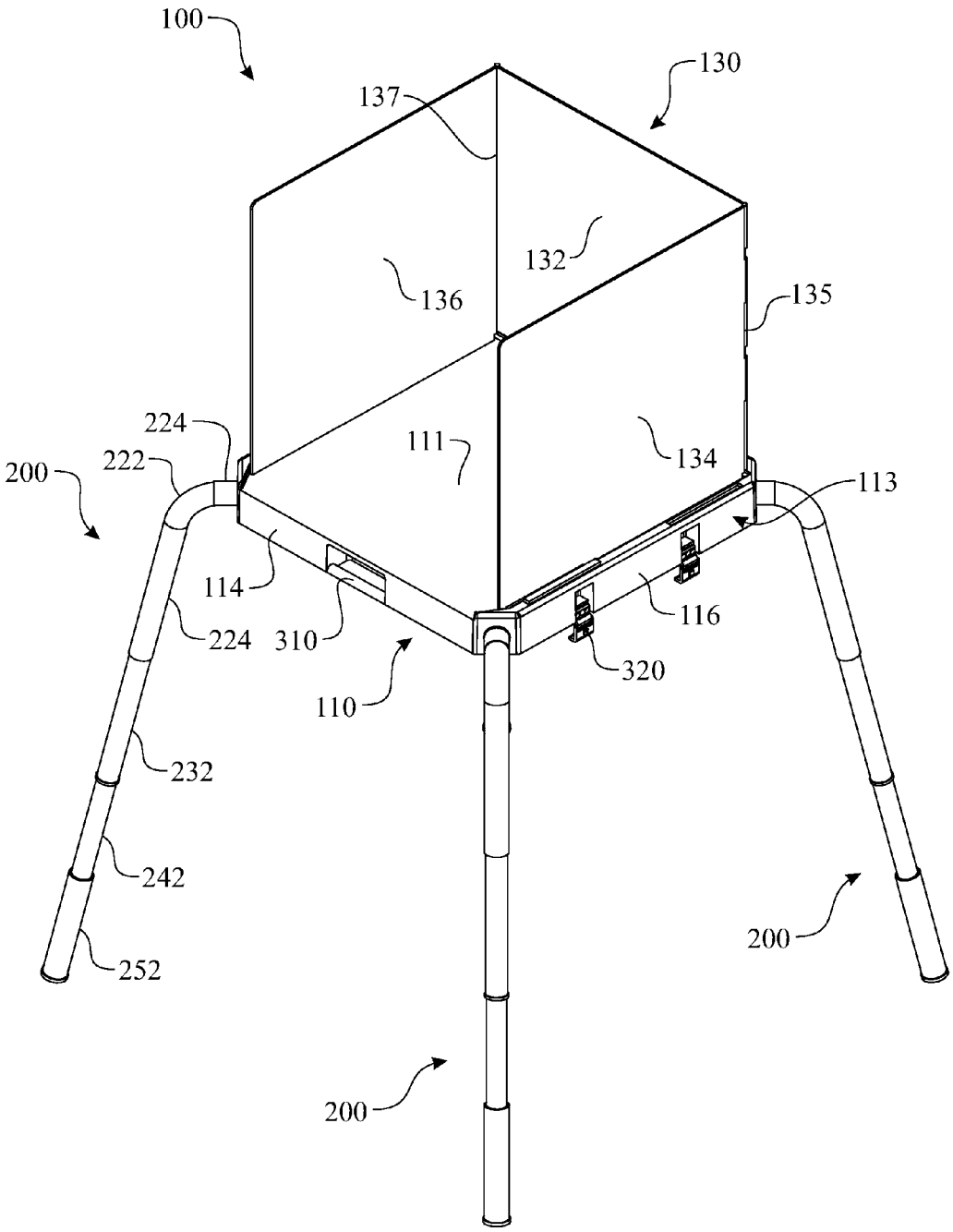
FIG. 1 is an isometric top view of an exemplary assembled multi-configuration voting booth illustrated in a deployed configuration, including extended support legs and a deployed privacy panel.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. In other implementations, well-known features and methods have not been described in detail so as not to obscure the invention. For purposes of description herein, the terms "upper", "lower", "left", "right", "front", "back", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments that may be disclosed herein are not to be considered as limiting, unless the claims expressly state otherwise.

A first exemplary multi-configuration voting booth 100 is illustrated in FIGS. 1 through 14. The multi-configuration voting booth 100 includes a voting tabletop assembly 110, a plurality of support leg assemblies 200 pivotally coupled to the voting tabletop assembly 110, and a segmented privacy panel assembly 130 designed to be supported by the voting tabletop assembly 110. The segmented privacy panel assembly 130 is preferably foldably coupled to a voting tabletop surface 111 of the voting tabletop assembly 110.

Figure 9:
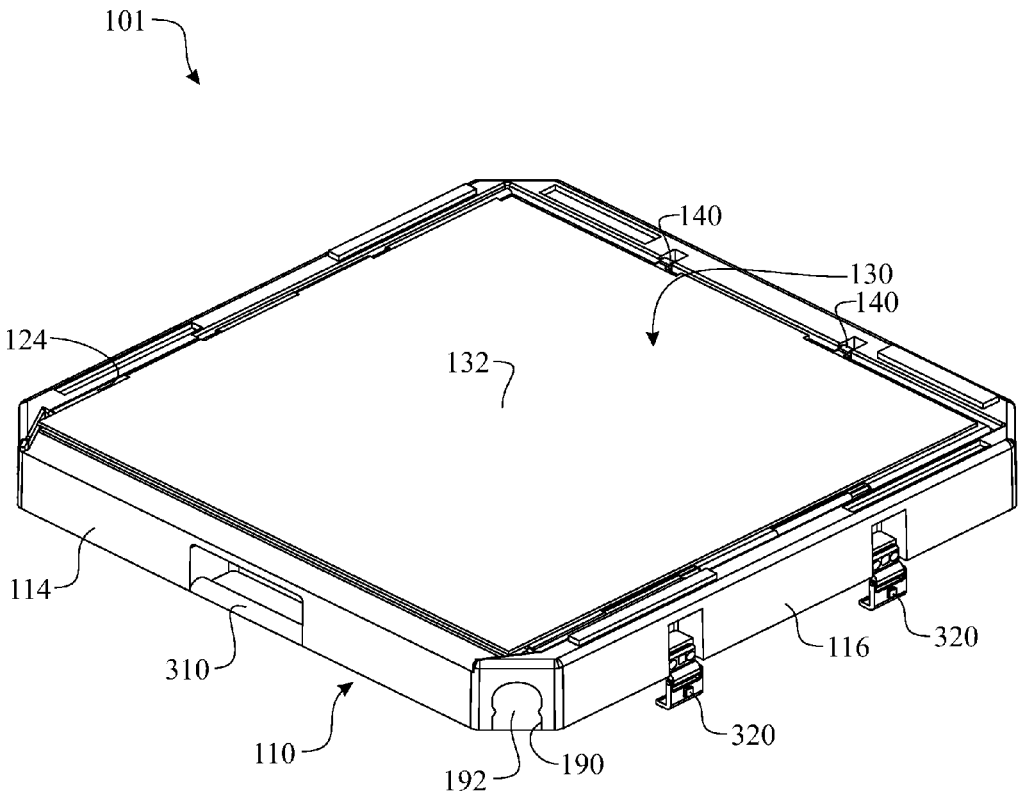
FIG. 9 is an isometric top view of the multi-configuration voting booth illustrated in a storage configuration wherein the privacy panel assembly is positioned into a parallel and flush arrangement respective to an upper surface of the voting tabletop assembly.

The voting tabletop assembly 110 is fabricated having a square shaped structure comprising a perimeter wall 113 downwardly extending from a perimeter edge of a voting tabletop surface 111. The perimeter wall 113 is segmented into a handle portion of perimeter wall 114, a clip portion of perimeter wall 116, a clip receiving portion of perimeter wall 118, and a floor support portion of perimeter wall 119. The perimeter wall 113 and a voting tabletop underside surface 112 of the voting tabletop assembly 110 collectively form a voting table bottom cavity 120 (introduced in FIG. 2) used for storing the support leg assemblies 200. Various features can be integrated into the molded voting tabletop assembly 110. At least one carrying handle 310 can be formed in the perimeter wall 113, more specifically in the handle portion of perimeter wall 114. The carrying handle 310 aids the user in transporting the multi-configuration voting booth 100. At least one storage support feature 312 can be integrated into the perimeter wall 113, more specifically in the floor support portion of perimeter wall 119. The storage support features 312 provide support during shipping and storage of the multi-configuration voting booth 100 when converted into a stored voting booth 101 (FIG. 9). It is understood that the voting tabletop assembly 110 can be fabricated of any material using any known process or processes related to the selected material. The voting tabletop assembly 110 is preferably fabricated of a molded plastic.

Each corner of the perimeter wall 113 is chamfered. A leg port 190 is shaped within each chamfered corner section enabling passage of the support leg assembly 200 therethrough. The leg port 190 is shaped to engage with and retain the support leg assembly 200 when deployed. An optional leg port cover 192 can be integrated into the voting tabletop assembly 110, providing a seal across the leg port 190 during storage. The exemplary leg port cover 192 is pivotally attached to the voting tabletop surface 111 by a leg port cover hinge 194. A cover flange 198 is formed about a peripheral portion of the 192, wherein the cover flange 198 rests against a seating flange 199 of the chamfered corner section. At least one port cover retention feature 196 secures the leg port cover 192 in a closed configuration. The port cover retention feature 196 can be a cantilevered clip (as shown), a rotational securing device, a sliding securing device, and the like.

The voting tabletop assembly 110 includes features to support and provide functional motion to the plurality of support leg assemblies 200. A leg assembly pivot support bracket 150 extends into the voting table bottom cavity 120 from the voting tabletop underside surface 112. The leg assembly pivot support bracket 150 is shaped to provide pivotal support to the support leg assembly 200 via a pivot pin 152. A collapsed leg retainer 157 extends into the voting table bottom cavity 120 from the voting tabletop surface 111. The collapsed leg retainer 157 includes a leg receiving aperture 158 having at least one leg retaining elements 159 located proximate a distal end thereof. The leg assembly pivot support bracket 150 is shaped to support and retain the support leg assembly 200 in a closed configuration. The leg assembly pivot support bracket 150, the collapsed leg retainer 157, and the leg port 190 are located in linear registration with the lateral rotation 156 of the support leg assembly 200.

An optional deployed leg retaining pin bracket 180 is integrated into the voting tabletop assembly 110. The deployed leg retaining pin bracket 180 includes a retaining pin assembly aperture 181 for assembly of a biased deployed leg retaining pin 182. The deployed leg retaining pin bracket 180 is inserted through the retaining pin assembly aperture 181 and secured in location by a pin assembly retention member 183. An engaging pin section 186 is operated by a retaining pin grip 184. A biasing element (not shown, but well understood), such as a tensile spring, is integrated therein to retain the engaging pin section 186 in an engaging state. A locking member engaging arm 188 is assembled to the support leg assembly 200 at a location and orientation wherein the engaging pin section 186 is inserted through a locking member retention aperture 189 (FIG. 2) of the locking member engaging arm 188 to aid in retaining the support leg assembly 200 in a deployed configuration. It is understood that other locking mechanisms can be employed, providing the same benefits as a combination of the biased deployed leg retaining pin 182 and locking member engaging arm 188.

Figure 6:
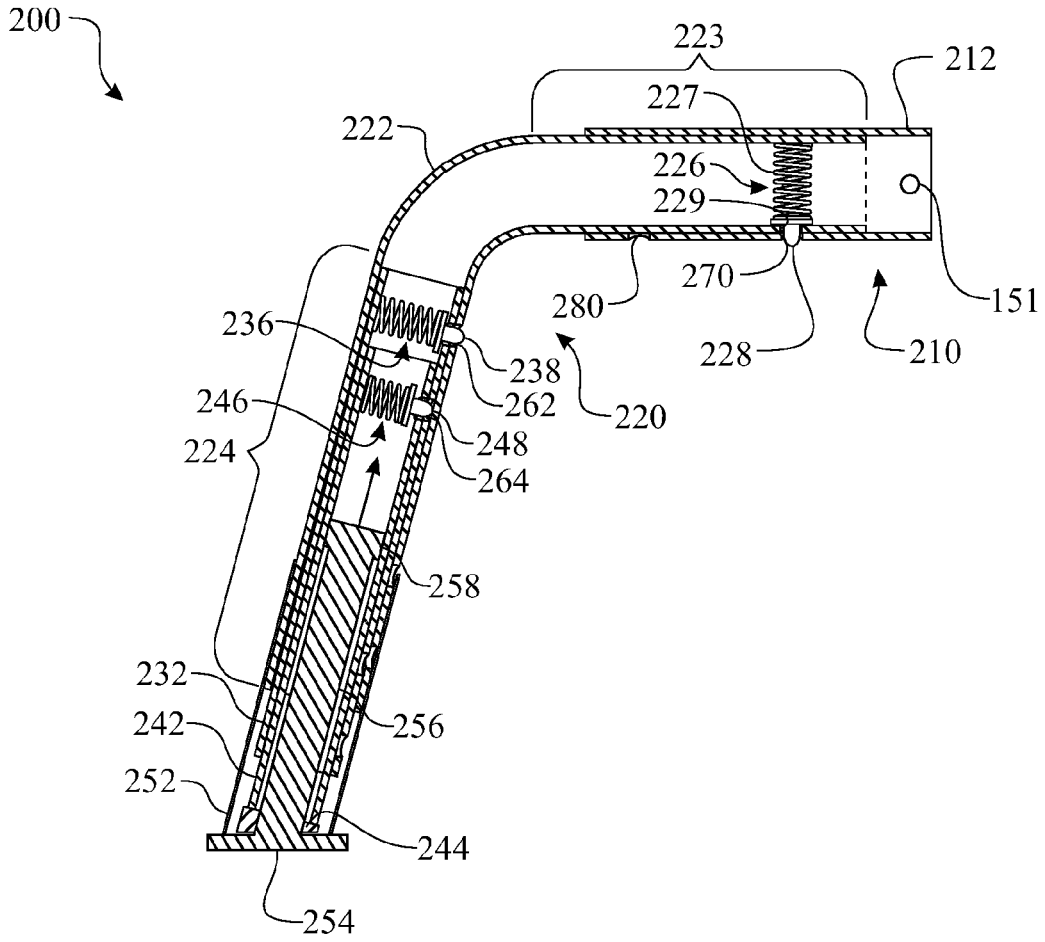
FIG. 6 is a cross sectional view of the exemplary support leg, illustrating the telescopic segments of the support leg in a collapsed configuration for storage.
Figure 7:
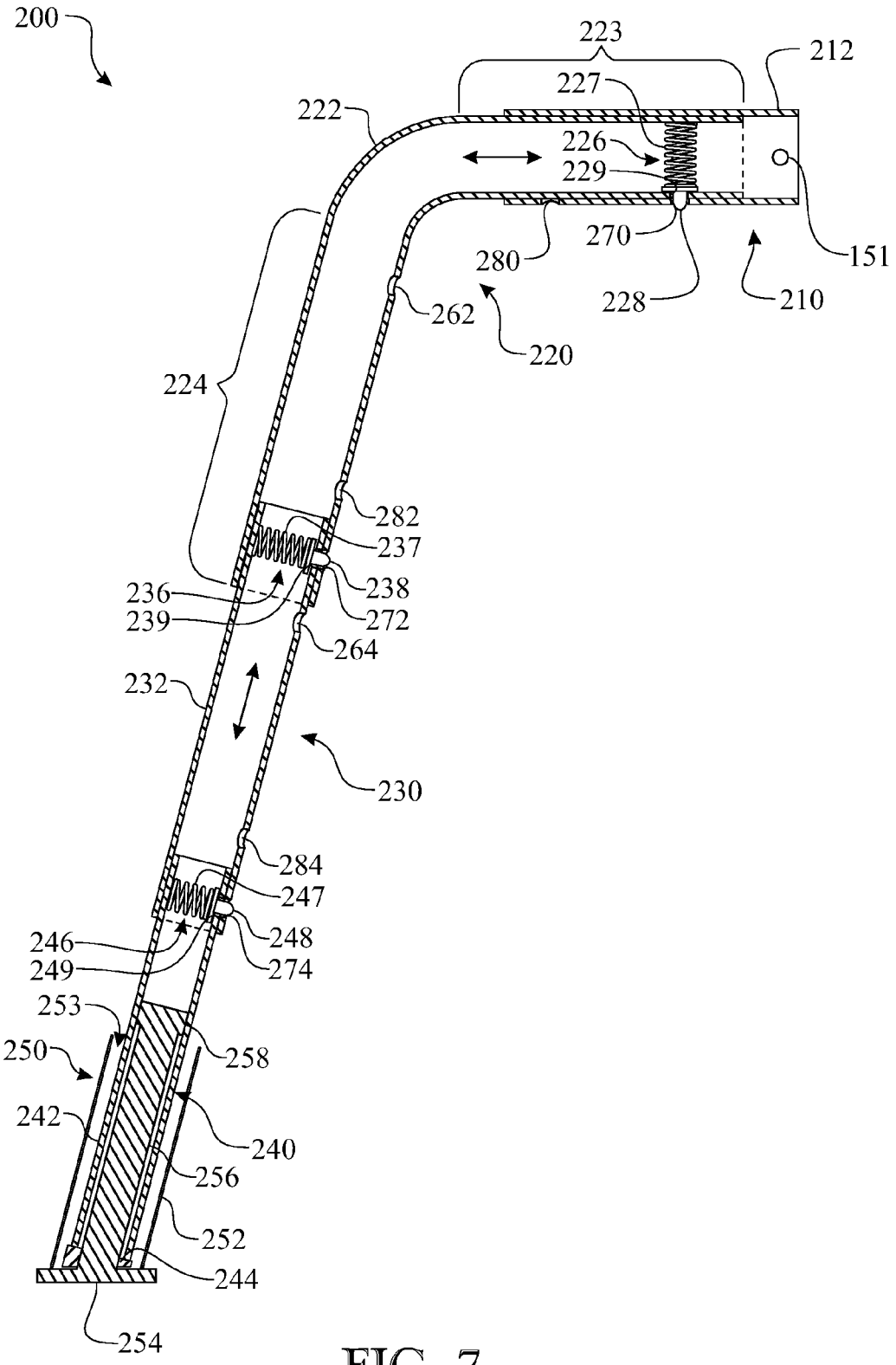
FIG. 7 is a cross sectional view of the exemplary support leg, illustrating the telescopic segments of the support leg in a standard deployment configuration.
Figure 8:
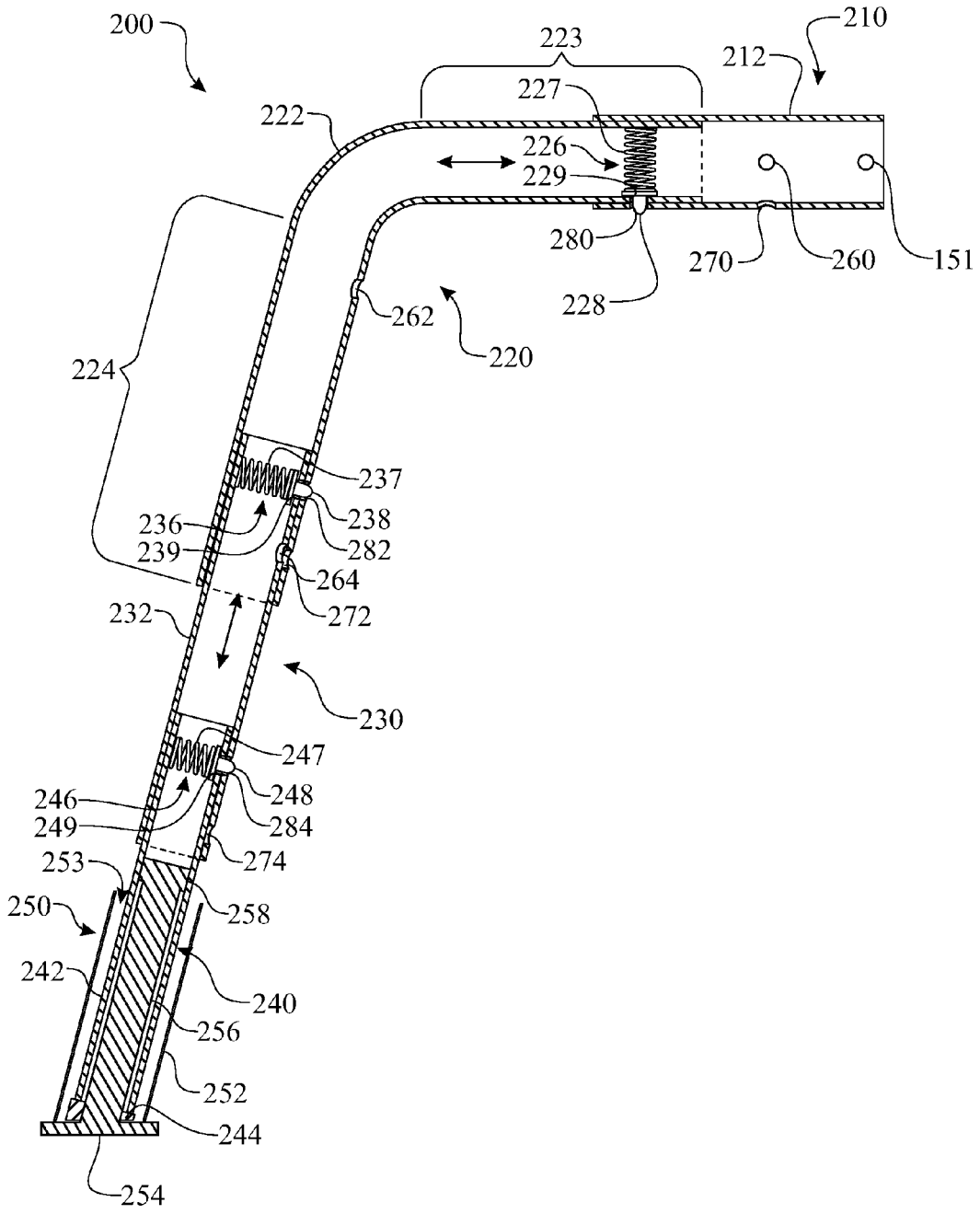
FIG. 8 is a cross sectional view of the exemplary support leg, illustrating the telescopic segments of the support leg in a handicapped accommodating deployment configuration.

Element and functional details of the support leg assembly 200 are best illustrated in FIGS. 6 through 8. The support leg assembly 200 includes a pivotally attached leg member 210, a directional transition leg member 220, a central telescoping leg member 230, and a base telescoping leg member 240. The directional transition leg member 220 provides a transition between a horizontal longitudinal axial direction and an angled height direction. The directional transition leg member 220 can be fabricated of a single member defined by three segments or an assembly of three separate members, the segments including a leg elbow segment 222, a horizontally telescoping leg segment 223, and a height telescoping upper leg segment 224. The horizontally telescoping leg segment 223 provides the horizontal contribution to an adjustable direction. The horizontally telescoping leg segment 223 additionally provides an axial rotational contribution to the support leg assembly 200, wherein the axial rotational contribution aids in conversion between the stored configuration and the deployed configuration. The leg elbow segment 222 provides a transitional contribution to the adjustable direction between a horizontal adjusting orientation and a generally vertical adjusting orientation. In the exemplary embodiment, the generally vertical adjusting orientation is angled to aid in transverse stability of the multi-configuration voting booth 100. The terms vertical, height, and generally vertical all incorporate an angular orientation as illustrated unless otherwise limited. The height telescoping upper leg segment 224 provides the generally vertical or height contribution to the adjustable direction. The plurality of telescopically telescoping segments 224, 232, 242 inter disposed within one another to form a height adjustable support member. The telescoping segments 224, 232, 242 are configured for telescopic storage within a height telescoping upper leg segment 224.

Figure 2:
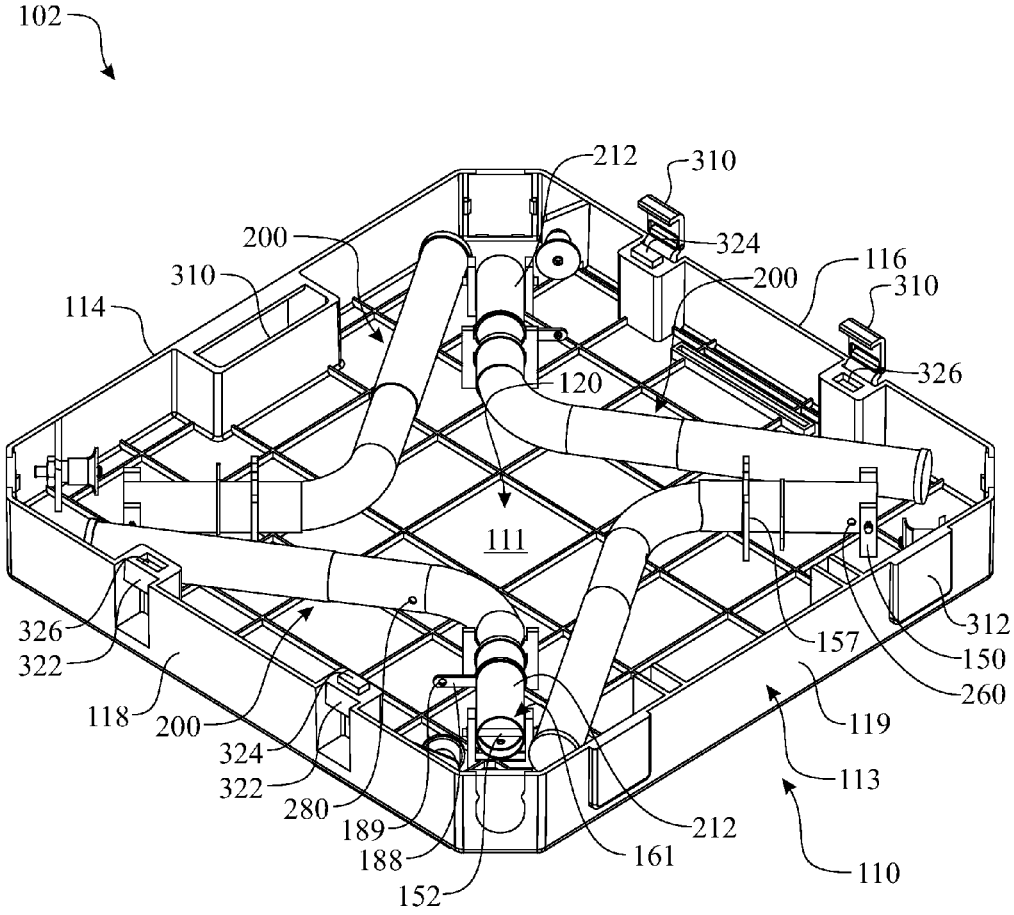
FIG. 2 is an isometric bottom view of the multi-configuration voting booth illustrated in a storage configuration, having all of the support legs positioned in a collapsed, storage configuration.
Figure 3:
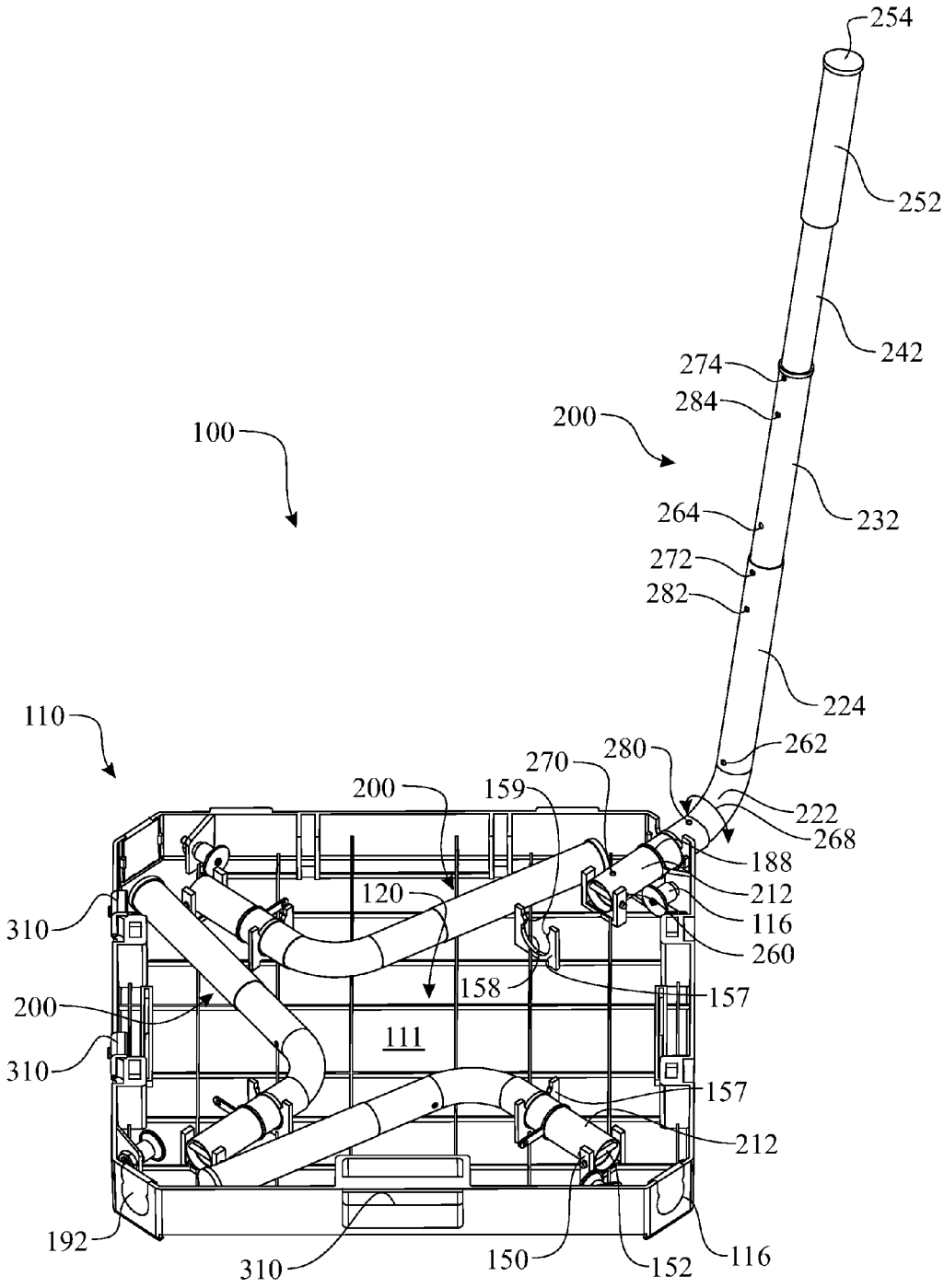
FIG. 3 is an isometric bottom view of the multi-configuration voting booth of FIG. 2, demonstrating an exemplary deployment process of a first support leg.
Figure 4:
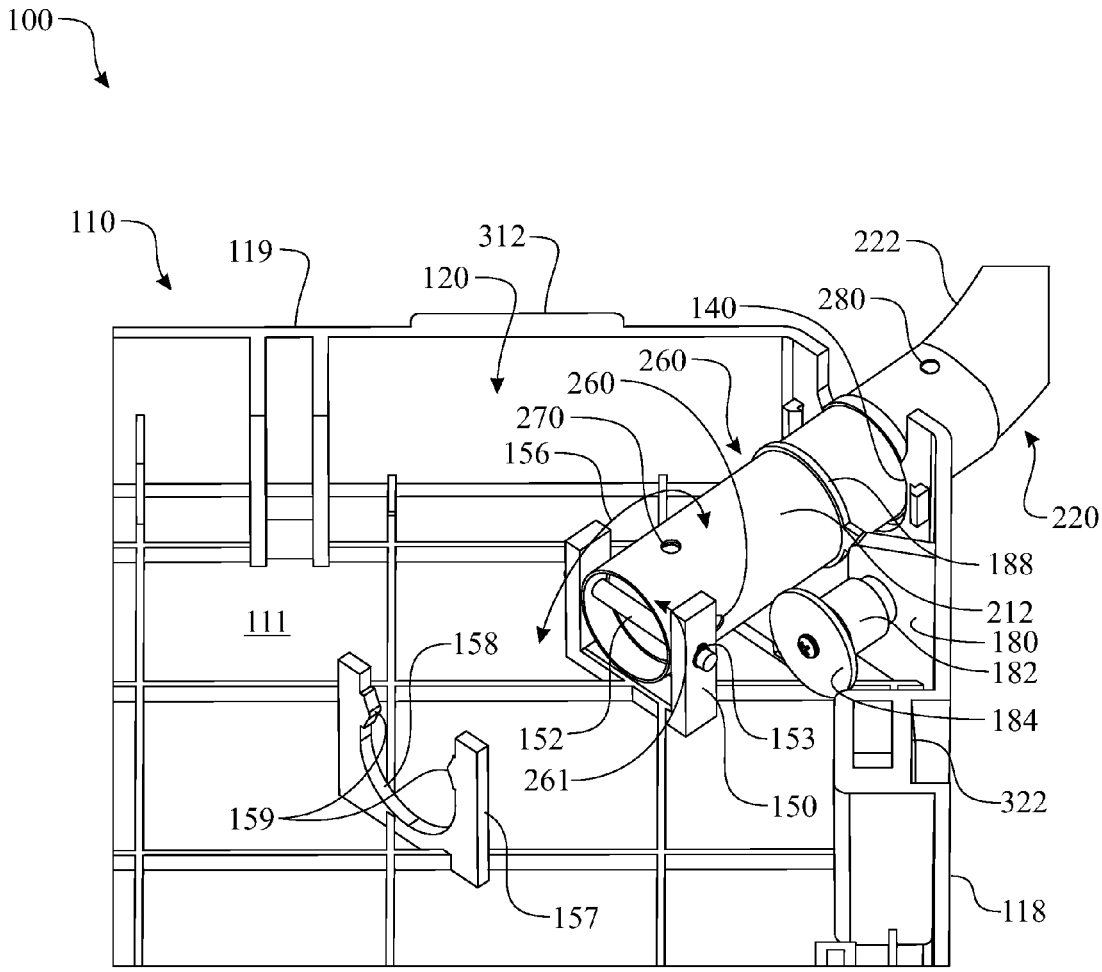
FIG. 4 is a magnified isometric bottom view detailing a pivot junction between an undersurface of the multi-configuration voting booth presenting an exemplary support leg in a deployed state incorporating a spring-actuated locking pin for retaining the support leg in the deployed state.
Figure 5:
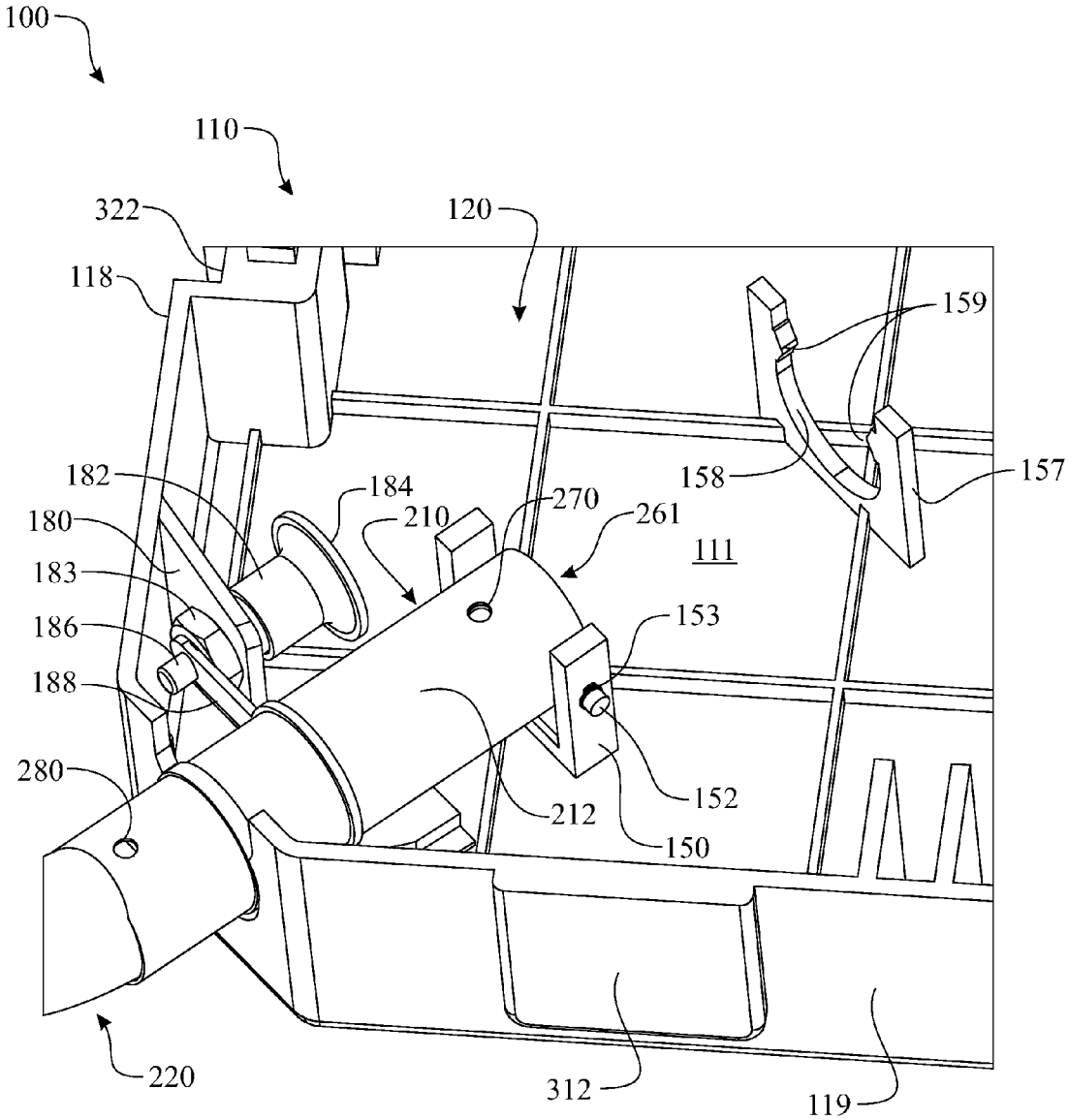
FIG. 5 is an rotated magnified isometric bottom view of FIG. 4 detailing an interface between the spring-actuated locking pin and a pin retention flange when the support leg is in a deployed state.

Functionally, the multi-configuration voting booth 100 is configured as a stored inverted voting booth 102 in FIG. 2, wherein all of the support leg assemblies 200 are oriented in a stored configuration. The support leg assemblies 200 are shown converting to a deployed configuration in FIGS. 3 through 5. Each support leg assembly 200 is pivotally attached to the leg assembly pivot support bracket 150 by a pivot pin 152. The pivot pin 152 pivotally assembles a pivotal leg segment 212 of the support leg assembly 200 and the leg assembly pivot support bracket 150 together. The pivot pin 152 is inserted through an aperture provided through a first wall segment of the leg assembly pivot support bracket 150, continuing through a pair of pin receiving apertures 151 formed through the pivotal leg segment 212 at a pivot end 211 of the pivotally attached leg member 210, and continuing through a second wall segment of the leg assembly pivot support bracket 150. The pivot pin 152 is secured in place using common hinge pin securing techniques, such as a pin retaining feature 153. The pin retaining feature 153 can be a flange, a retaining clip, a "C" clip, a threaded fastener, a setscrew, and the like or any combination thereof. This assembly configuration enables the support leg assembly 200 to pivot between a deployed configuration (FIGS. 3 through 5) and a stored configuration (FIGS. 2, 14) in accordance with a lateral rotation 156 (FIG. 4). In the exemplary embodiment, the rotation of the lateral rotation 156 is approximately 180 degrees.

The support leg assembly 200 includes a variety of moveable interfaces enabling a user to adjust the support leg assembly 200 into a desired configuration. The support leg assembly 200 can be converted between a stored or collapsed configuration (FIG. 6), a standard deployed configuration (FIG. 7), and a handicapped compatible configuration (FIG. 8). The handicapped compatible configuration would be in compliance with the ADA, having a height accommodating a person sitting in the wheelchair and a span between the support leg assembly 200 enabling a wheelchair to fit therebetween. Each segment includes a retention member assembly 226, 236, 246. The retention member can be of any applicable form factor known by those skilled in the art. Each exemplary retention member includes a retention member 228, 238, 248 retained in an engaging position by a retention member biasing element 227, 237, 247 respectively. The retention member 228, 238, 248 retractably extends through a retention member aperture 229, 239, 249 for engagement with a respective positioning aperture of an external slideably engaging member.

A plurality of predetermined sizing apertures is provided through the support leg assembly 200. A first series of predetermined sizing apertures are provided to define a collapsed configuration. The collapsed sizing apertures are identified by a prefix of "26". A second series of predetermined sizing apertures are provided to define a standard deployment configuration. The standard deployment apertures are identified by a prefix of "27". A third series of predetermined sizing apertures are provided to define a handicapped compatible deployment configuration. The handicapped compatible deployment apertures are identified by a prefix of "28". The pivotally attached leg member 210 includes a horizontal storage retention member aperture 260, a standard horizontal retention member aperture 270 and a handicapped accessible horizontal retention member aperture 280. The directional transition leg member 220 includes an upper height storage retention member aperture 262, a standard upper vertical retention member aperture 272 and a handicapped accessible upper vertical retention member aperture 282. The central telescoping leg member 230 includes a lower height storage retention member aperture 264, a standard lower vertical retention member aperture 274 and a handicapped accessible lower vertical retention member aperture 284. A foot member 244 is assembled to a distal end of the base telescoping leg member 240. The foot member 244 is preferably fabricated of a material, such as rubber, silicone, and the like, having a high coefficient of friction to help retain the multi-configuration voting booth 100 in position when deployed. The foot member 244 prevents and/or limits slippage of the support leg assembly 200 with respect to a floor surface.

The stored configuration telescopically retracts the horizontally telescoping leg segment 223 within the pivotal leg segment 212 via a longitudinal sliding motion as illustrated in FIG. 6. Additionally, the directional transition leg member 220 rotates within the pivotal leg segment 212 in accordance with the axial rotational motion 268, rotating the directional transition leg member 220 by 90 degrees about a longitudinal axis, positioning the retention member 228 to engage with the horizontal storage retention member aperture 260. The stored configuration telescopically retracts the telescoping segments 230, 240 within the height telescoping upper leg segment 224. The retention member 238 engages with the upper height storage retention member aperture 262 to secure the central telescoping leg member 230 within the height telescoping upper leg segment 224 in a retracted configuration. Similarly, the retention member 248 engages with the lower height storage retention member aperture 264 to secure the base telescoping leg member 240 within the central telescoping leg member 230 in a retracted configuration. Each biasing element 237, 247 retains the respective retention member 238, 248 in an extended or engaging position, retaining the support leg assembly 200 in a collapsed configuration. The collapsed assembly is then rotated about the pivot pin 152, engaging the pivotal leg segment 212 with the leg receiving aperture 158. The pivotal leg segment 212 is secured within the leg receiving aperture 158 by the at least one leg retaining elements 159. It is understood that any device used to retain the support leg assembly 200 in a stored configuration within the voting table bottom cavity 120 can be employed by the stored voting booth 101. The design of the multi-configuration voting booth 100 positions all of the support leg assemblies 200 completely within the voting table bottom cavity 120 as illustrated in FIG. 2.

Figure 15:
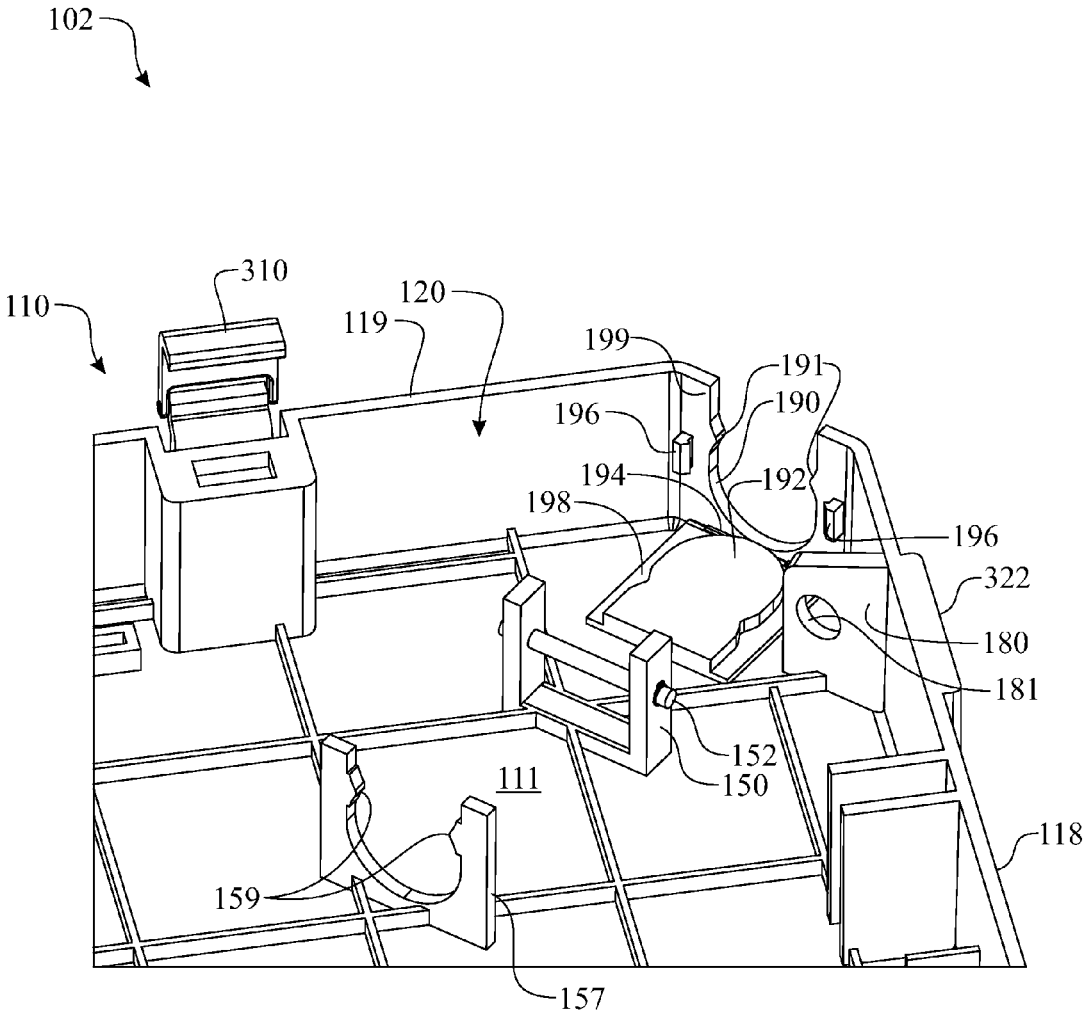
FIG. 15 is an enlarged isometric bottom view of the multi-configuration voting booth of FIG. 14 shown with the support legs removed, more specifically detailing the pivotally attached corner cover illustrated in a deployed state.

The standard configuration extends the vertical portion of the support leg assembly 200 to a maximum length as illustrated in FIG. 7. The leg port cover 192 is disengaged from the port cover retention feature 196 and folded inward as illustrated in FIG. 15, exposing the leg port 190 for use. The support leg assembly 200 is rotated about the pivot pin 152 into a deployed position, engaging the pivotal leg segment 212 with the leg port 190. The pivotal leg segment 212 is retained within the leg port 190 by at least one leg retaining elements 191 (FIG. 15). The retention member 228 is depressed, disengaging the retention member 228 from the horizontal storage retention member aperture 260, enabling the user to rotate the directional transition leg member 220 respective to the pivotal leg segment 212, aligning and engaging the retention member 228 with the standard horizontal retention member aperture 270. This motion orients the support leg assembly 200 extending downward from the voting tabletop assembly 110. The base telescoping leg member 240 is extended from the central telescoping leg member 230 via a longitudinal axial sliding motion, positioning the retention member 248 to engage with the standard lower vertical retention member aperture 274. The central telescoping leg member 230 is extended from the height telescoping upper leg segment 224 via a longitudinal axial sliding motion, positioning the retention member 238 to engage with the standard upper vertical retention member aperture 272. This configuration positions the voting tabletop underside surface 112 at an industry standard height and a distance between leg assemblies 200 at an industry standard span.

The handicapped compatible configuration extends the vertical portion of the support leg assembly 200 to a length that is slightly shorter than the standard configuration as illustrated in FIG. 8. From a stored configuration the leg port cover 192 is disengaged from the port cover retention feature 196 and folded inward as illustrated in FIG. 15, exposing the leg port 190 for use. The support leg assembly 200 is rotated about the pivot pin 152 into a deployed position, engaging the pivotal leg segment 212 with the leg port 190. The pivotal leg segment 212 is retained within the leg port 190 by at least one leg retaining elements 191. The retention member 228 is depressed, disengaging the retention member 228 from the horizontal storage retention member aperture 260, enabling the user to rotate and longitudinally slide the directional transition leg member 220 respective to the pivotal leg segment 212, aligning and engaging the retention member 228 with the handicapped accessible horizontal retention member aperture 280. This motion orients the support leg assembly 200 extending outward and downward from the voting tabletop assembly 110. The base telescoping leg member 240 is extended from the central telescoping leg member 230 via a longitudinal axial sliding motion, positioning the retention member 248 to engage with the handicapped accessible lower vertical retention member aperture 284. The central telescoping leg member 230 is extended from the height telescoping upper leg segment 224 via a longitudinal axial sliding motion, positioning the retention member 238 to engage with the handicapped accessible upper vertical retention member aperture 282. This configuration positions the voting tabletop underside surface 112 at an industry defined handicapped accessible height and a distance between leg assemblies 200 at an industry defined handicapped accessible span.

Each of the support leg assemblies 200 is fabricated of a sturdy, lightweight material, such as aluminum. It is understood that the support leg assemblies 200 can be fabricated of other materials such as reinforced plastics, other metals, composites, and the like. The exemplary support leg assembly 200 is fabricated of tubular sections having a circular cross section shape. It is understood that the cross section can be of any shape.

An optional leg over assembly 250 can be integrated into the support leg assembly 200 for aesthetics, function, extended life of the support leg assembly 200, and the like. The leg over assembly 250 can also be utilized to increase an overall height provided by the support leg assembly 200. In an extending configuration, the leg over assembly 250 can include a leg cover foot 254. A leg cover axial support segment 256 can extend upwards from the leg cover foot 254, wherein the leg cover axial support segment 256 slideably engages with an aperture through the foot member 244. A leg cover positioning support member 258 can be provided proximate a distal end of the leg cover axial support segment 256. The leg cover positioning support member 258 would have a peripheral size and shape to engage with an interior surface of the base telescoping vertical leg segment 242. The engagement of the leg cover axial support segment 256 with the aperture of the foot member 244 and the leg cover positioning support member 258 with the interior surface of the base telescoping vertical leg segment 242 provides rigidity to the leg over assembly 250. A retention member (not shown), similar to the retention member assembly 226, 236, 246 can be incorporated within the leg cover positioning support member 258 to retain the leg over assembly 250 at a desired extended position. A leg cover sleeve 252 can extend upwards from the leg cover foot 254. An interior diameter of the leg cover sleeve 252 is preferably sized to cover the base telescoping vertical leg segment 242 when collapsed.

The optional retaining pin grip 184 can be used to aid in retaining the support leg assembly 200 in a deployed configuration. The support leg assembly 200 would be rotated into a deployed configuration, positioning the pivotally attached leg member 210 within the leg port 190. The user would retract the engaging pin section 186 by applying a tensile force to the retaining pin grip 184. The leg would be positioned aligning the locking member retention aperture 189 with the engaging pin section 186. The user would release the tensile force from the retaining pin grip 184, enabling the engaging pin section 186 to engage with the locking member retention aperture 189. It would be understood by those skilled in the art that the biased deployed leg retaining pin 182 could be replaced by any securing feature known by those skilled in the art that would be suitable for the application.

Figure 10:
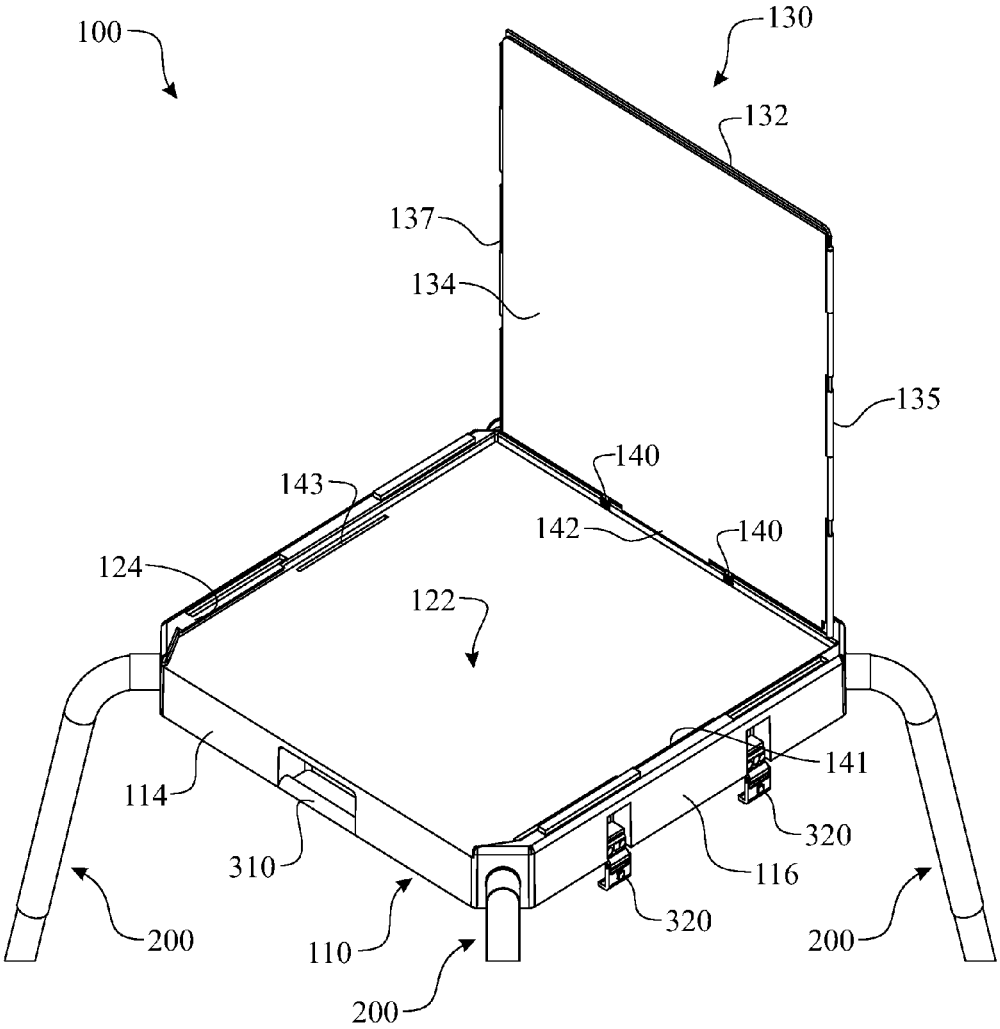
FIG. 10 is an isometric top view of the multi-configuration voting booth demonstrating a first step of deploying the exemplary privacy panel assembly by rotating the privacy shield assembly into a vertical orientation.

The privacy panel assembly 130 is best described in FIGS. 9 through 13. The privacy panel assembly 130 includes a rear privacy panel 132, a first side privacy panel 134 and a second side privacy panel 136. The segmented privacy panel assembly 130 is designed for retention with the voting tabletop assembly 110 during storage and deployment. The segmented privacy panel assembly 130 is pivotally assembled to the voting tabletop surface 111 by at least one privacy shield base hinge 140. The privacy shield base hinge 140 pivotally couples a lower edge of the rear privacy panel 132 and the voting tabletop assembly 110 together as shown in FIGS. 9 and 10. The first side privacy panel 134 is hingably coupled to the rear privacy panel 132 along a first common vertical edge 135. Correspondingly, the second side privacy panel 136 is hingably coupled to an opposite second common vertical edge 137 of the rear privacy panel 132. It is understood that the segmented privacy panel assembly 130 can be fabricated of any material or combination of materials using any known process or processes related to the selected material. The segmented privacy panel assembly 130 is preferably fabricated of a molded plastic.

Figure 11:
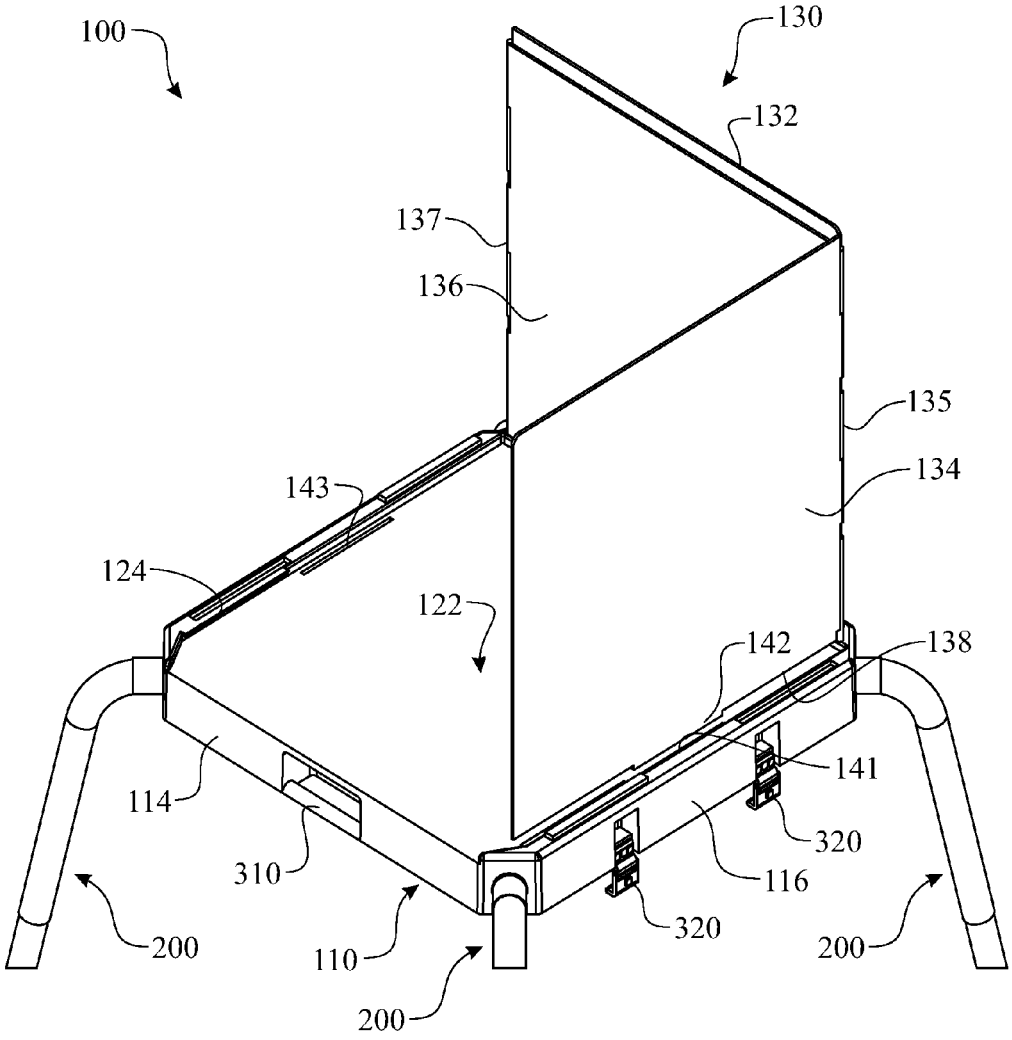
FIG. 11 is an isometric top view of the multi-configuration voting booth of FIG. 10 demonstrating a second step of deploying the exemplary privacy panel assembly by rotating a first side privacy panel into position.
Figure 12:
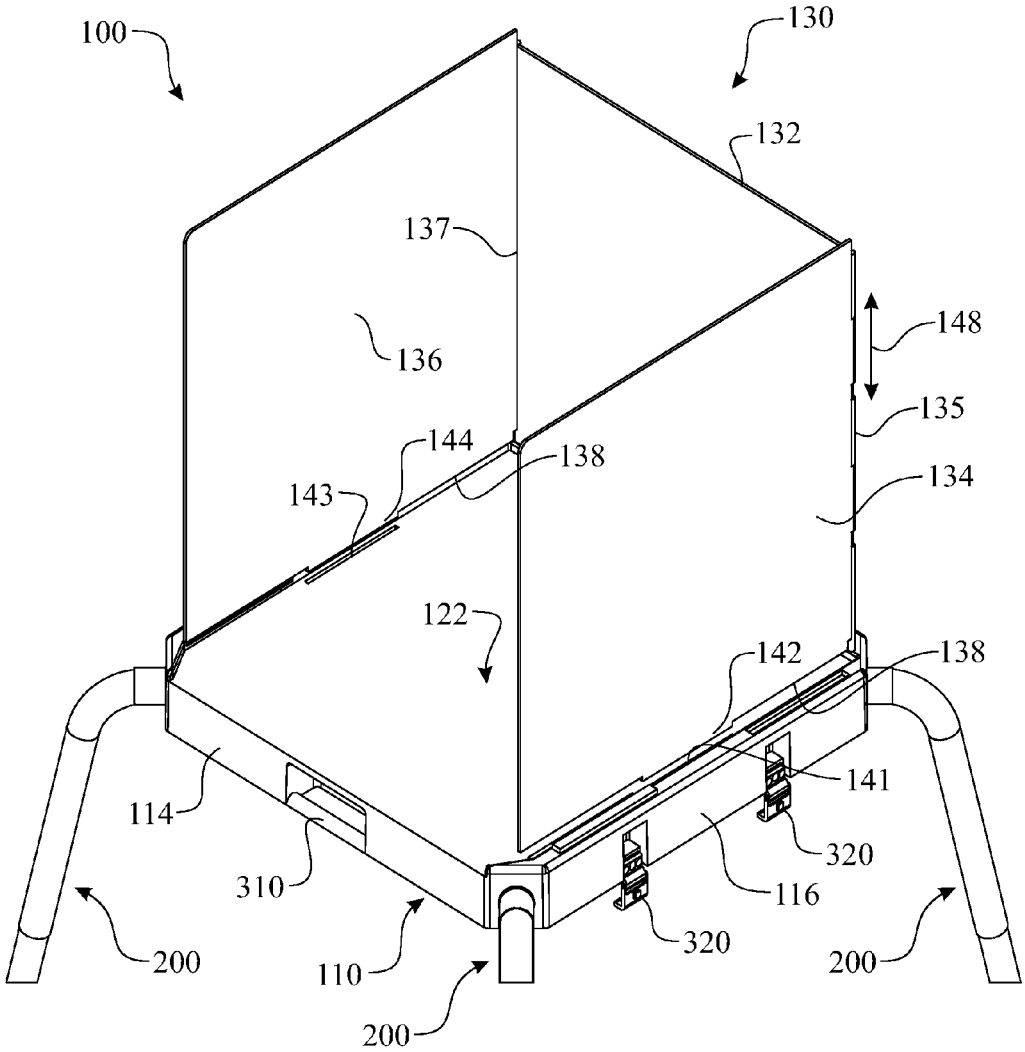
FIG. 12 is an isometric top view of the multi-configuration voting booth of FIG. 11 demonstrating a third step of deploying the exemplary privacy panel assembly by rotating a second side privacy panel into position and aligning the panel retention tabs with each respective slot.
Figure 13:
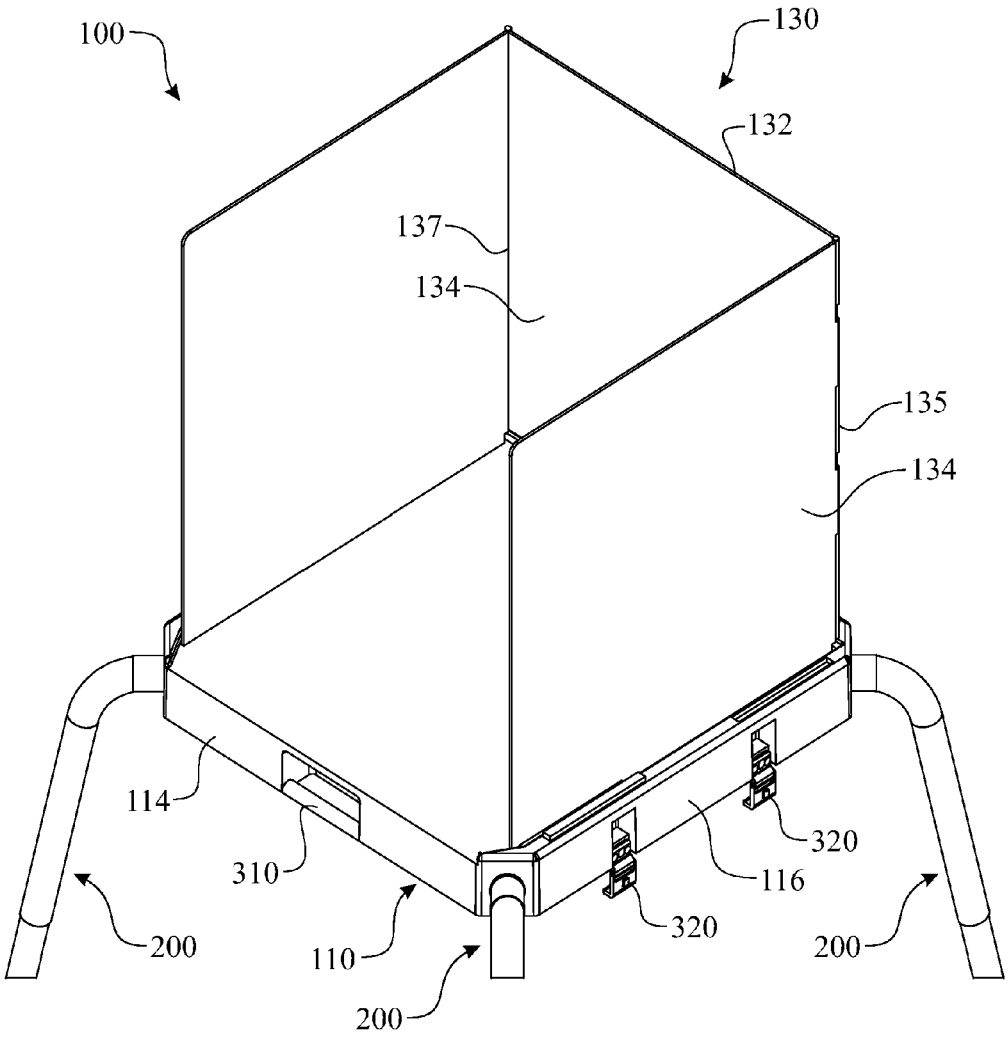
FIG. 13 is an isometric top view of the multi-configuration voting booth of FIG. 12 demonstrating a final step of deploying the exemplary privacy panel assembly by inserting the panel retention tabs into each respective slot.
Figure 14:
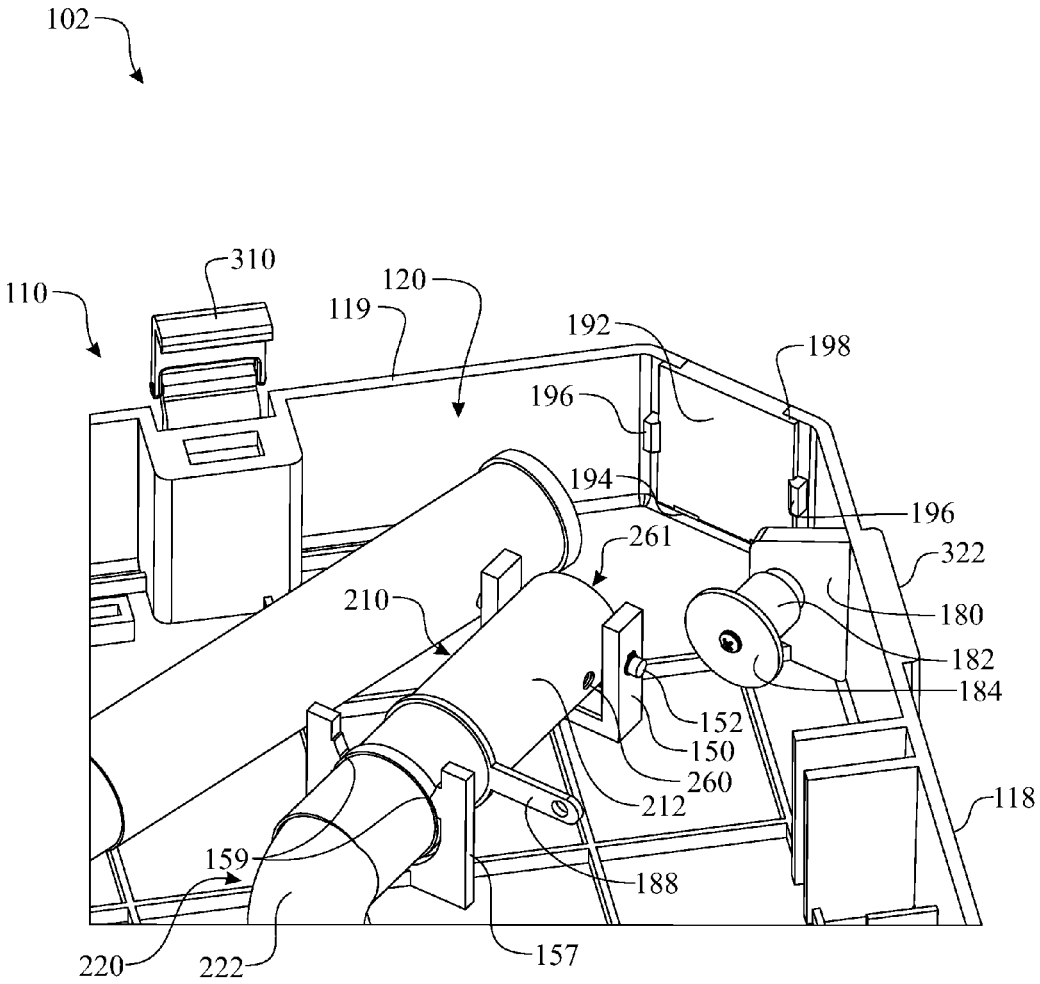
FIG. 14 is an enlarged isometric bottom view of the multi-configuration voting booth illustrated in a collapsed configuration, more specifically detailing a pivotally attached corner cover illustrated in a storage state.

The privacy panel assembly 130 is deployed by rotating the privacy panel assembly 130 about the privacy shield base hinge 140 upward positioning the rear privacy panel 132 into a substantially vertical orientation as illustrated in FIG. 10. The first side privacy panel 134 is rotated aligning a first side privacy shield tab 142 located along a privacy shield assembly lower edge 138 of the first side privacy panel 134 proximate a first side privacy shield tab receiving slot 141 of the voting tabletop assembly 110 as illustrated in FIG. 11. The second side privacy panel 136 is rotated aligning a second side privacy shield tab 144 located along a privacy shield assembly lower edge 138 of the second side privacy panel 136 proximate a second side privacy shield tab receiving slot 143 of the voting tabletop assembly 110 as illustrated in FIG. 12. The hinges provided along each of the common vertical edges 135, 137 can include a vertical sliding motion referenced as an axial hinge sliding motion 148. The axial hinge sliding motion 148 aids the insertion of the privacy shield tabs 142, 144 into the respective shield tab receiving slots 141, 143. The segmented privacy panel assembly 130 is secured in location by inserting the privacy shield tabs 142, 144 into the respective shield tab receiving slots 141, 143.

Although the exemplary embodiment attaches the segmented privacy panel assembly 130 to the voting tabletop assembly 110 via a privacy shield base hinge 140, it is understood that the segmented privacy panel assembly 130 can be coupled to or removably attached to the voting tabletop assembly 110 using any suitable interface known by those skilled in the art. It is noted that the segmented privacy panel assembly 130 is sized and shaped to be stored within a privacy shield storage receptacle 122 formed within the voting tabletop surface 111. A privacy shield retention member 124, such as a clip, can be employed to retain the segmented privacy panel assembly 130 within the privacy shield storage receptacle 122 while being stored.

Converting the multi-configuration voting booth 100 to the stored voting booth 101, the segmented privacy panel assembly 130 is collapsed into a folded configuration by reversing the above described deployment process. The segmented privacy panel assembly 130 is rotated into the voting tabletop underside surface 112 and secured in the storage configuration by the privacy shield retention member 124. Each of the support leg assembly 200 is retracted by applying a releasing force to each respective retention member 228, 238, 248 for disengagement and sliding each of the telescoping members 230, 240 into a collapsed configuration. The retention members 228, 238, 248 are positioned to engage with the respective storage retention member apertures 260, 262, 264. The engaging pin section 186 is released from each of the locking member retention apertures 189 of each support leg assemblies 200. Each of the collapsed support leg assemblies 200 is rotated in accordance with the lateral rotation 156 and secured into the leg receiving aperture 158, placing the support leg assemblies 200 into a storage configuration. The leg port cover 192 is rotated into a position to seal the leg port 190. The leg port cover 192 is secured into the closed positioned by resting the cover flange 198 against the seating flange 199 and securing the leg port cover 192 by at least one port cover retention feature 196. This is repeated for each of the multi-configuration voting booths 100.

Each voting tabletop assembly 110 includes a series of features to aid in storing the stored voting booths 101. The voting tabletop assembly 110 can include a plurality of alignment tabs 324 and respective mating alignment recesses 326. In the exemplary configuration, one alignment tab 324 and one alignment recess 326 is integrated into an exposed edge of each of the clip portion of perimeter wall 116 and clip receiving portion of perimeter wall 118. It is understood that the alignment tab 324 and mating alignment recess 326 can be located anywhere on the exposed edge of the perimeter wall 113 in an opposite relation on opposite sides of the perimeter wall 113. This configuration enables the stored voting booth 101 and stored inverted voting booth 102 to mate together, and remain in registration with one another, entrapping the support leg assemblies 200 therebetween.

At least one carrying handle 310 is assembled to the clip portion of perimeter wall 116. A clip mating feature 322 is integrated into the clip receiving portion of perimeter wall 118, wherein each clip mating feature 322 is located to mate with each respective carrying handle 310. Each carrying handle 310 of the first stored voting booth 101, 102 engages with each respective clip mating feature 322 of the second stored voting booth 101, 102 retaining the stored voting booth 101 and stored inverted voting booth 102 together. The joined stored voting booth 101 and stored inverted voting booth 102 are referred to as a joined voting booth pair 103, as illustrated in FIG. 16.

Figure 16:
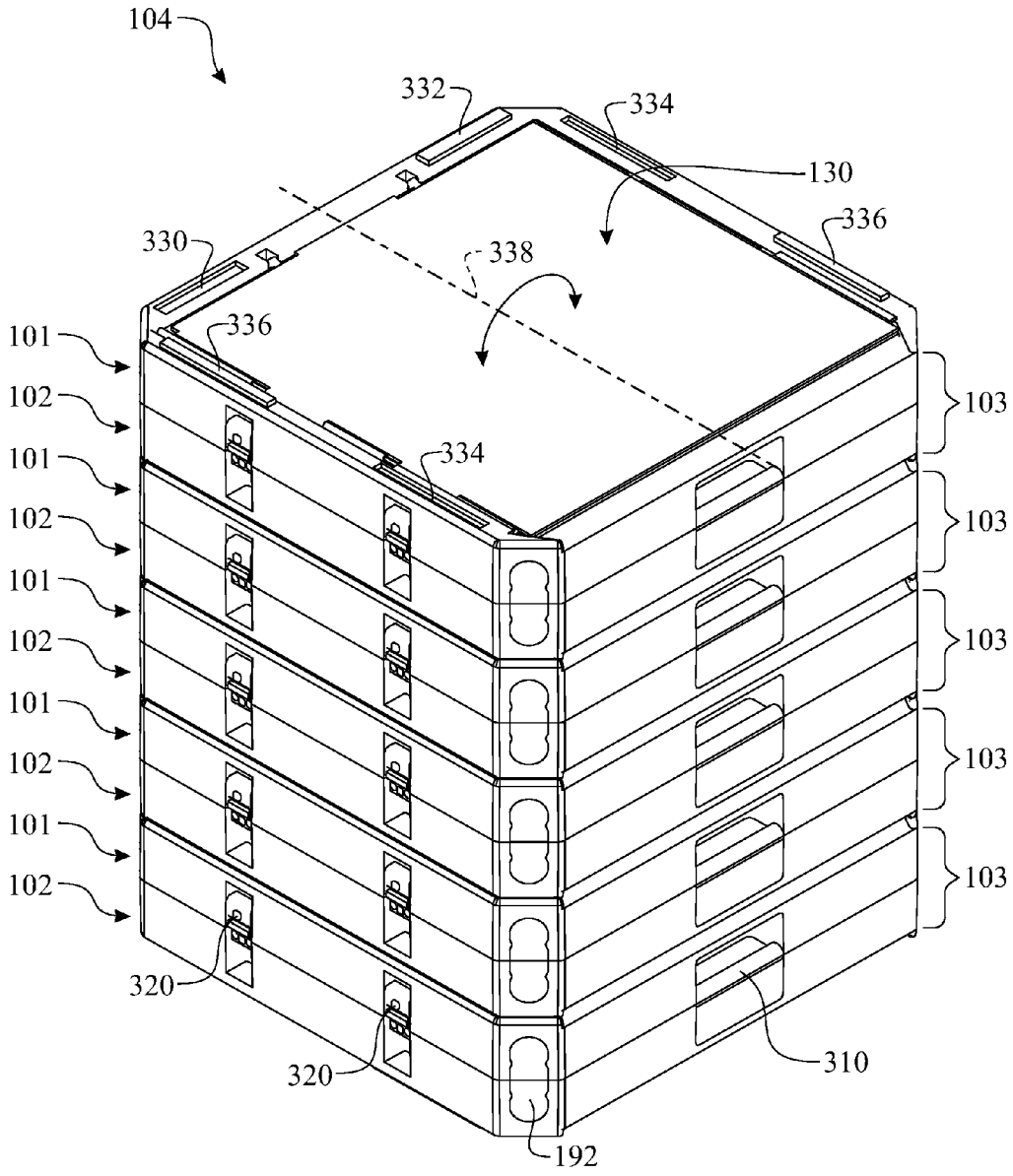
FIG. 16 is an isometric top view of a plurality of multi-configuration voting booths oriented in a storage configuration, each voting booth mated with a paired adjacent voting booth in an opposite (mirrored) orientation and the series placed in a stacked configuration.
Figure 17:
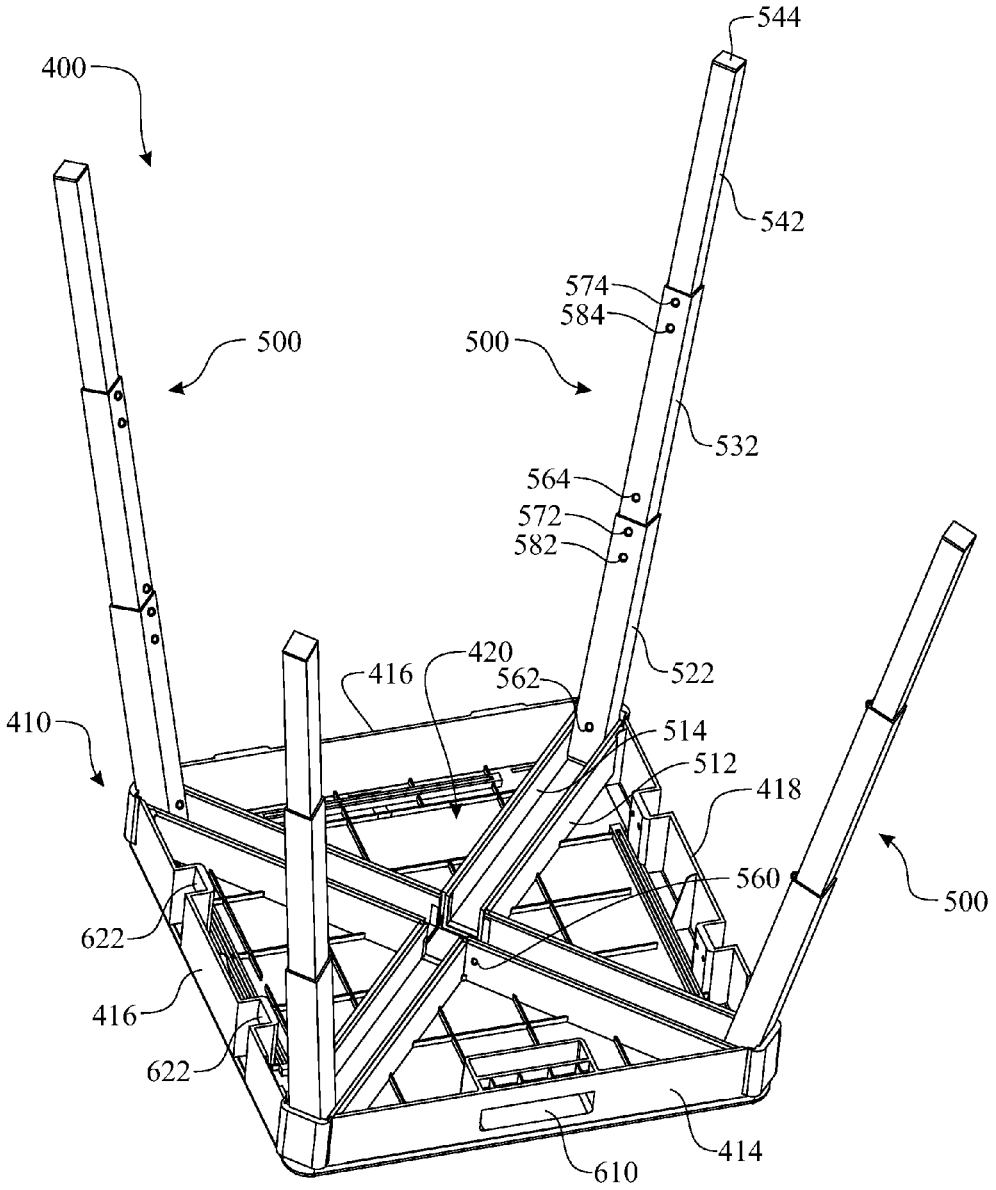
FIG. 17 is an isometric bottom view of the undersurface of a second exemplary embodiment of a multi-configuration voting booth illustrated in a standard deployment configuration, wherein the support legs are telescopically extended to their vertical maximum length and positioned in a horizontally retracted configuration.
Figure 18:
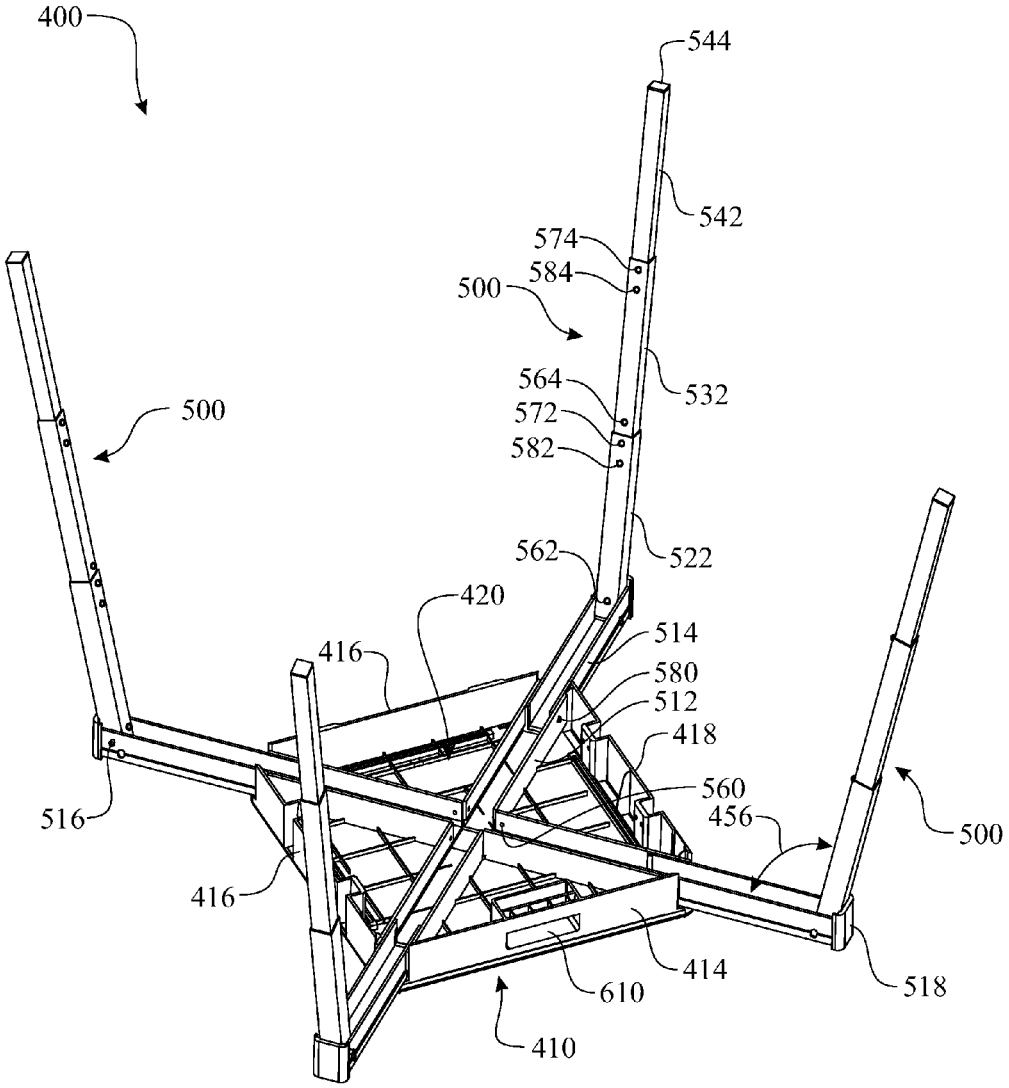
FIG. 18 is an isometric bottom view of the undersurface of a second embodiment of a multi-configuration voting booth of FIG. 17 further illustrating the support legs in a horizontally expanded and vertically reduced ADA compliant configuration.
Figure 19:
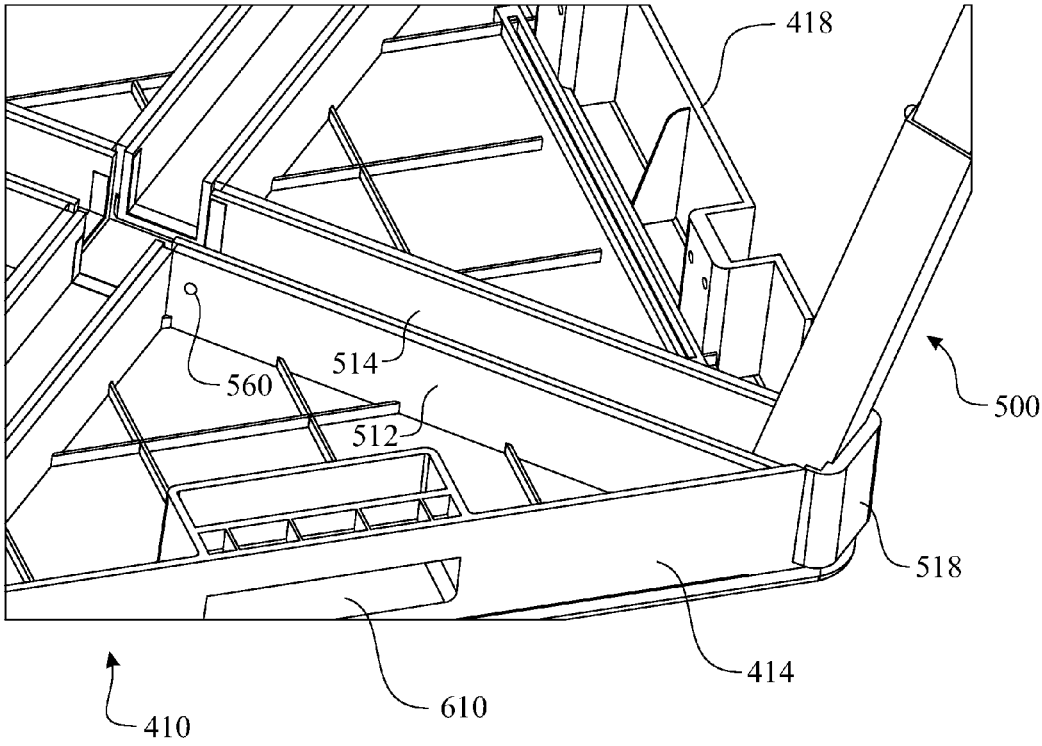
FIG. 19 is a magnified isometric bottom view of the operational interface between the undersurface of the multi-configuration voting booth and a support leg assembly, wherein the support leg assembly is illustrated in a horizontally retracted configuration.
Figure 20:
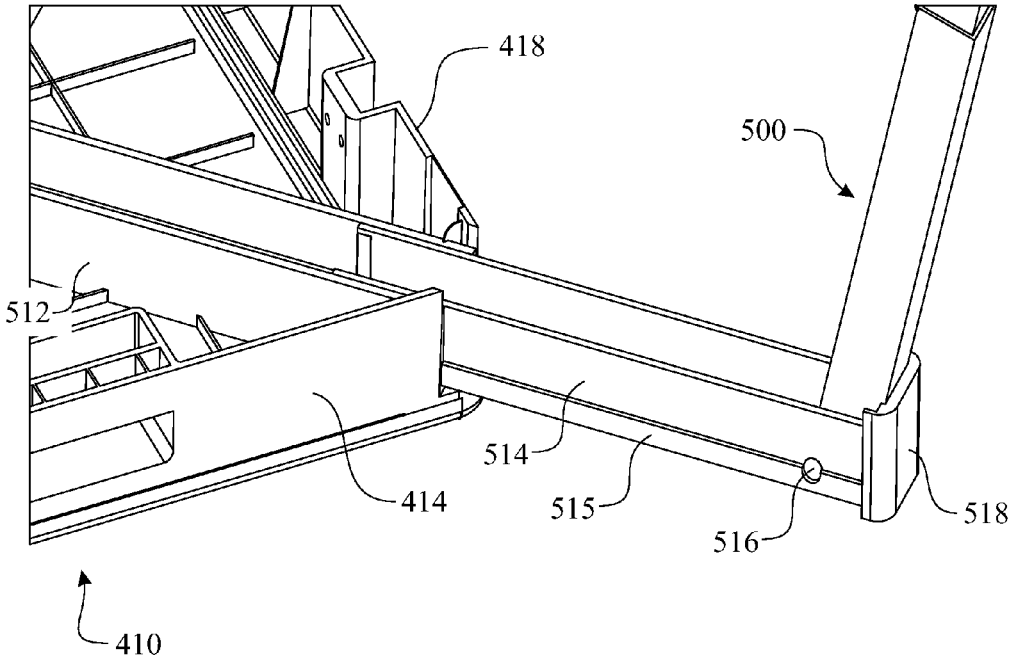
FIG. 20 is a magnified isometric bottom view of the junction between the undersurface of the multi-configuration voting booth and a support leg assembly, wherein the support leg assembly is illustrated in a horizontally expanded ADA compliant configuration.

The voting tabletop assembly 110 further includes several features that aid in stacking a plurality of joined voting booth pairs 103 together as illustrated in FIG. 16 to form a series of stacked voting booths 104. A longitudinal recess 330 and a longitudinal boss 332 are formed upon an upper surface of the voting tabletop assembly 110, wherein the longitudinal recess 330 and longitudinal boss 332 are located parallel to one side, in a mirrored arrangement about an inverting axis 338. A lateral recess 334 and/or a lateral boss 336 are provided on each of a first and an opposite side of the upper surface of the voting tabletop assembly 110, wherein the lateral recess 334 and respective lateral boss 336 are also located in a mirrored arrangement about the inverting axis 338. Each longitudinal recess 330 of the first stored voting booth 101, 102 engages with each respective longitudinal boss 332 of the second stored voting booth 101, 102. Similarly, each lateral recess 334 of the first stored voting booth 101, 102 engages with each respective lateral boss 336 of the second stored voting booth 102, 101 and each lateral boss 336 of the first stored voting booth 101, 102 engages with each respective lateral recess 334 of the second stored voting booth 101, 102. The engagement between the boss and tabs retains the plurality of stored voting booth 101, 102 in a stacked configuration. Additionally, the longitudinal recess 330, the opposing mating side recesses 334, the longitudinal boss 332, and the opposing mating side bosses 336 are located on the voting tabletop assembly 110 guaranteeing the like orientations between joined voting booth pairs 103. The stacking configuration between mating joined voting booth pairs 103 entraps the segmented privacy panel assembly 130 therebetween. It is understood that the boss and tabs can be replaced with any reasonable registration interface known by those skilled in the art.

The multi-configuration voting booth 100 utilizes a pivotal relation between the support leg assembly 200 and the voting tabletop assembly 110. A multi-configuration voting booth 400 utilizes a sliding relation between a support leg assembly 500 and a voting tabletop assembly 410, as illustrated in FIGS. 17 through 20. The multi-configuration voting booth 400 comprises elements similar to the multi-configuration voting booth 100. Like features of the multi-configuration voting booth 400 and the multi-configuration voting booth 100 are numbered the same except preceded by the numeral '4'. The support leg assembly 500 comprises elements similar to the support leg assembly 200. Like features of the support leg assembly 500 and the support leg assembly 200 are numbered the same except preceded by the numeral '5'. Ancillary features to the voting tabletop assembly 410 are similar to those (which are preceded by the numeral "3") of the voting tabletop assembly 110 and are numbered the same except preceded by the numeral '6'.

The support leg assembly 500 includes telescoping members 532, 542 that telescope and retract from and within a leg elbow segment 522. The exemplary support leg assembly 500 is fabricated of tubular sections having a square cross section shape. This geometric tubular shape retains alignment between retention members and the retention member apertures. It is understood that the cross section can be of any shape. The leg elbow segment 522 is pivotally coupled to a horizontally sliding leg segment 514 by a leg pivot pin 516. The horizontally sliding leg segment 514 is slideably assembled to a sliding leg segment support rail 512. The horizontally sliding leg segment 514 is retained within the sliding leg segment support rail 512 by a sliding tongue feature 515, limiting the motion to a longitudinal sliding motion. The sliding tongue feature 515 slides within a mating track formed within the sliding leg segment support rail 512.

To deploy the multi-configuration voting booth 400, the user would select the desired configuration between a standard configuration and a handicapped accessible configuration. For either configuration, the user would rotate the leg elbow segment 522 from the horizontally sliding leg segment 514 in accordance with a lateral rotation 456. A horizontally sliding leg end cap 518 is provided on a distal end of each horizontally sliding leg segment 514, wherein the horizontally sliding leg end cap 518 retains the leg elbow segment 522 at a predetermined angle. Each horizontally sliding leg end cap 518 also provides a seal to each respective corner of the voting tabletop assembly 410. To accommodate the standard configuration, the horizontally sliding leg segment 514 would remain retracted within the sliding leg segment support rail 512. The horizontally sliding leg segment 514 would be retained in the retracted position by engaging a retention member (similar to the retention member 228) within a horizontal storage retention member aperture 560. To convert the multi-configuration voting booth 400 into the handicapped accessible configuration, the user would additionally release a retention member from engagement with a horizontal storage retention member aperture 560, slideably position the horizontally sliding leg segment 514 outward from the sliding leg segment support rail 512. The horizontally sliding leg segment 514 would be retained in an extended position by engaging the retention member within a handicapped accessible horizontal retention member aperture 580. The telescoping members 532, 542 would be extended to a length respective to the selected configuration, wherein the telescoping members 532, 542 are partially extended for the handicapped accessible configuration or fully extended for the standard configuration.

Although a privacy panel assembly is not shown in the illustrated embodiment, it is understood that a privacy panel assembly would be incorporated with the multi-configuration voting booth 400. The privacy panel assembly would be similar to the segmented privacy panel assembly 130 previously described herein.

Figure 21:
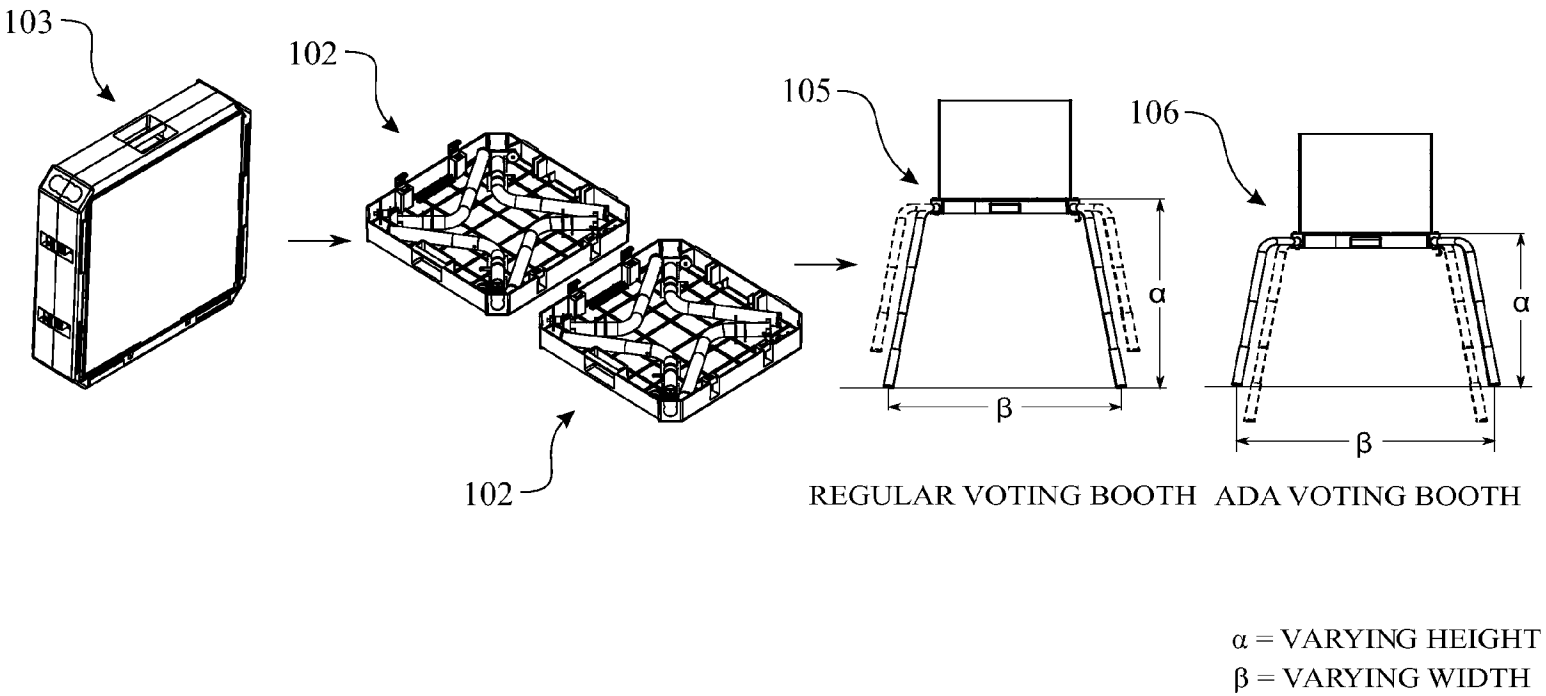
FIG. 21 is a schematic progression of the multi-configuration voting booth illustrating the separation of a pair of coupled multi-configuration voting booth further illustrating height and width variables between an ADA configuration and a regular.
Figure 22:
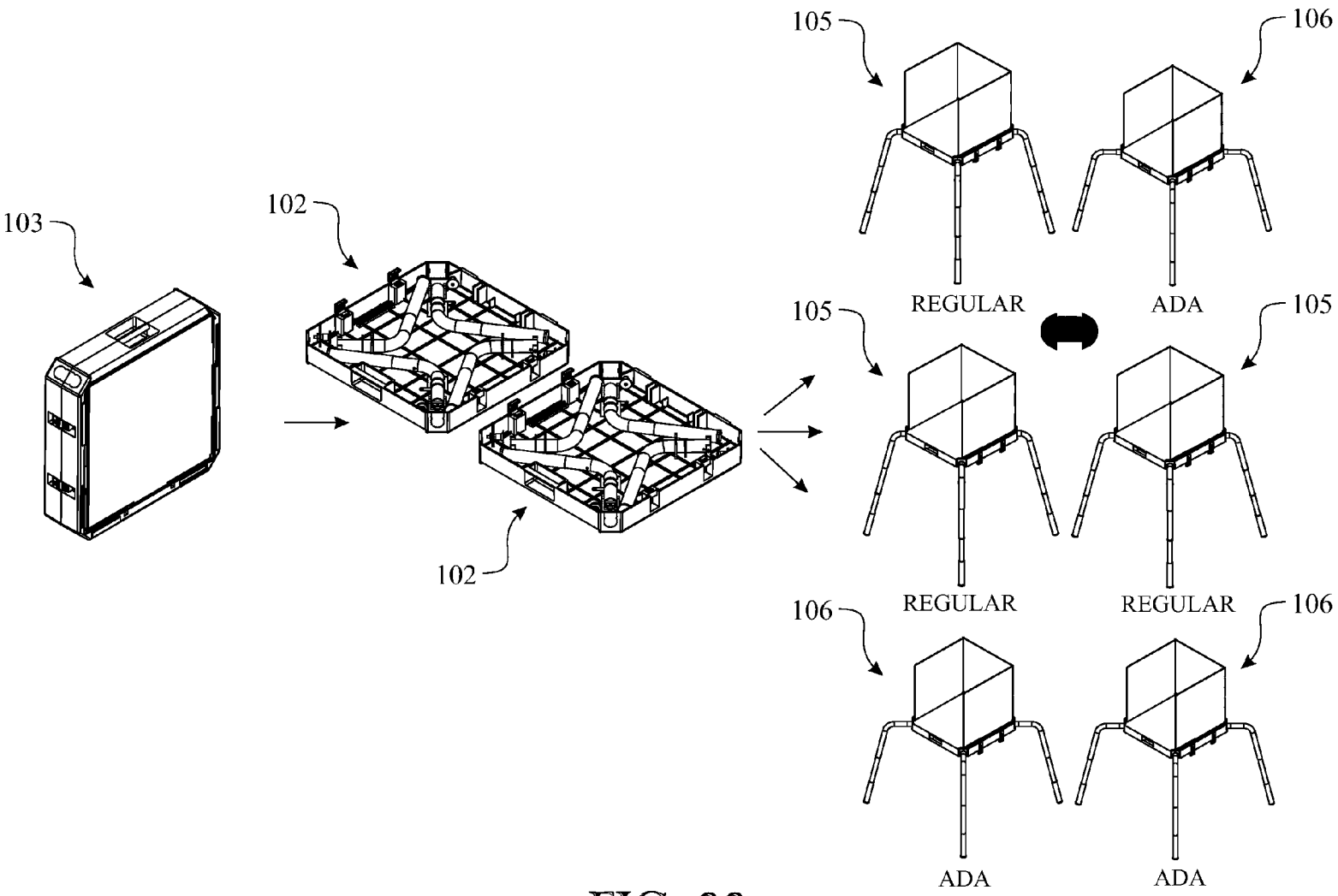
FIG. 22 is a schematic progression of the multi-configuration voting booth illustrating the separation of a pair of coupled multi-configuration voting booth further illustrating exemplary permutations of regular and ADA configurations.

In operation as illustrated in FIG. 21, a pair of multi-configuration voting booths 100 are initially joined together and referred to as a joined voting booth pair 103. To begin, each joined voting booth pair 103 is separated and deployed as a pair of multi-configuration voting booths 100 (wherein each multi-configuration voting booth 100 is illustrated as a stored inverted voting booth 102). Next the support leg assembly 200, 500 are deployed such that they are positioned into a deployed state by either rotating the support leg and holder into operational position or conversely, longitudinally slid into operational position in the case of the alternative embodiment. At this point, many combinations and permutations of the pair of multi-configuration voting booths 100 may be employed. For example one multi-configuration voting booth 100 can be configured into a standard configuration voting booth 105 and the other can be configured into a handicapped accessible configuration voting booth 106. Alternatively, both multi-configuration voting booths 100 may be placed into either the standard configuration voting booth 105 or the handicapped accessible configuration voting booth 106. In FIG. 21 the height is designated by the symbol α (alpha), and the width is designated by the symbol β (beta). In a deployed configuration suitable for a standard application (for non-handicapped people), the height α of the multi-configuration voting booth will be set to a standard height, for example 33 inches. Further, in this standard configuration the width β will be set to the minimum lateral spacing of the support leg assemblies 200, 500 such that optimum density of voting booths may be provided in a given voting area. In the case where an ADA compliant voting booth is desired, the height α of the multi-configuration voting booth can be set to a reduced height α of 30 inches, to comfortably accommodate a person in wheelchair. Additionally, in the ADA compliant configuration, configuration the width β will be set to a span or lateral spacing of between 40 and 50 inches extending between the support leg assemblies 200, 500 such that a person in a wheelchair can position themselves between the support leg assemblies 200, 500 of the handicapped accessible configuration voting booth 106.

As will be now apparent to those skilled in the art, the multi-configuration voting booths 100 fabricated according to the teachings of the present invention are capable of substantially enhancing the setup, configuration, and operation of a voting event. The present invention provides collapsible portable voting booths 100 that are user configurable between the standard configuration voting booth 105 and the handicapped accessible configuration voting booth 106 (compatible with the American Disabilities Act-For Handicapped Persons). Where, the handicapped accessible configuration voting booth 106 extends the support legs outwardly to create a wider stance between the legs, enabling a wheelchair to fit therebetween. Additionally, the voting tabletop surface 111 is lowered for improved compatibility with a voter sitting in a wheelchair. In addition, the invention provides a voting tabletop assembly 110 that employs collapsible support leg assemblies 200, 500 that store within a bottom cavity 120, 520 of the voting booth 100. Further the invention provides a privacy panel assembly 130 that is simply and effectively deployed such that voter privacy is maintained. Finally, the multi-configuration voting booth described further provides for mechanical coupling of a pair of voting booths 101, 102 in an opposing mirrored orientation that permits and facilitates compact storage and transportation of the voting booths 100, 400.

Although the above provides a full and complete disclosure of the preferred embodiments of the invention, various modifications, combinations, alternate constructions and equivalents will occur to those skilled in the art. It is intended that all matters in the foregoing description and shown in the accompanying drawings be interpreted as illustrative and not in a limiting sense. Therefore the above should not be construed as limiting the invention, which is defined by the appended claims and their legal equivalence.

What is claimed is:

1. A multi-configuration voting booth, comprising:

a voting tabletop assembly having a tabletop top surface, a tabletop bottom surface, and a perimeter wall, the perimeter wall extending downward from a peripheral edge of the tabletop bottom surface, the perimeter wall and tabletop bottom surface collectively defining a bottom cavity;

a plurality of support leg assemblies attached to the voting tabletop assembly, wherein the legs are configurable between a stored configuration locating each entire collapsed leg within the bottom cavity, a standard deployed configuration positioning the support leg assemblies at a first predetermined span and a first predetermined vertical dimension, and a handicapped configuration positioning the support leg assemblies at a second predetermined span and a second predetermined vertical dimension, wherein the second span is greater than the first span, and the first vertical dimension is greater than the second vertical dimension;

a rotational interface provided between a pivotally attached leg member located at an attachment end of the support leg assembly and a horizontally telescoping leg segment of the support leg assembly, wherein the rotational interface rotates the support leg assembly respective to the pivotally attached leg member about the longitudinal axis of the respective support leg assembly;

a privacy panel assembly including a rear panel defined by a lower edge, an upper edge, a first vertical edge, and a second vertical edge; a first side panel attached to the first rear panel vertical edge and a second side panel attached to the second rear panel vertical edge; and an interface retaining the privacy panel assembly and the voting tabletop assembly together, wherein the privacy panel assembly is configured extending upwards from a position proximate three sides of a perimeter of the voting tabletop assembly.

2. A multi-configuration voting booth as recited in claim 1, further comprising a pivotal interface provided between the privacy panel assembly and the voting tabletop assembly together.

3. A multi-configuration voting booth as recited in claim 1, further comprising a pivotal interface provided between each support leg assembly and the voting tabletop assembly, wherein the pivotal interface rotates each support leg assembly about an axis perpendicular to the longitudinal axis of the respective support leg assembly.

4. A multi-configuration voting booth as recited in claim 1, further comprising at least one leg storage retention feature for retaining each support leg assembly in a storage configuration.

5. A multi-configuration voting booth as recited in claim 1, further comprising at least one leg deployment retention feature for retaining each support leg assembly in a deployed configuration.

6. A multi-configuration voting booth as recited in claim 1, further comprising at least one coupling interface for retaining a plurality of voting table assemblies in a stacked configuration.

7. A multi-configuration voting booth, comprising:

a voting tabletop assembly having a tabletop top surface, a tabletop bottom surface, and a perimeter wall, the perimeter wall extending downward from a peripheral edge of the tabletop bottom surface, the perimeter wall and tabletop bottom surface collectively defining a bottom cavity;

a plurality of support leg assemblies attached to the voting tabletop assembly, wherein the legs are configurable between a stored configuration locating each entire collapsed leg within the bottom cavity, a standard deployed configuration positioning the support leg assemblies at a first predetermined span and a first predetermined vertical dimension, and a handicapped configuration positioning the support leg assemblies at a second predetermined span and a second predetermined vertical dimension, wherein the second span is greater than the first span, and the first vertical dimension is greater than the second vertical dimension;

a rotational interface provided between a pivotally attached leg member located at an attachment end of the support leg assembly and a horizontally telescoping leg segment of the support leg assembly, wherein the rotational interface rotates the support leg assembly respective to the pivotally attached leg member about the longitudinal axis of the respective support leg assembly;

a privacy panel assembly including a rear panel defined by a lower edge, an upper edge, a first vertical edge, and a second vertical edge; a first side panel pivotally attached to the first rear panel vertical edge and a second side panel pivotally attached to the second rear panel vertical edge; and an interface retaining the privacy panel assembly and the voting tabletop assembly together, wherein the privacy panel assembly is configured extending upwards from a position proximate three sides of a perimeter of the voting tabletop assembly.

8. A multi-configuration voting booth as recited in claim 7, further comprising a pivotal interface provided between the privacy panel assembly and the voting tabletop assembly together.

9. A multi-configuration voting booth as recited in claim 7, further comprising a pivotal interface provided between each support leg assembly and the voting tabletop assembly, wherein the pivotal interface rotates each support leg assembly about an axis perpendicular to the longitudinal axis of the respective support leg assembly.

10. A multi-configuration voting booth as recited in claim 7, further comprising at least one leg storage retention feature for retaining each support leg assembly in a storage configuration.

11. A multi-configuration voting booth as recited in claim 7, further comprising at least one leg deployment retention feature for retaining each support leg assembly in a deployed configuration.

12. A multi-configuration voting booth as recited in claim 7, further comprising at least one coupling interface for retaining a plurality of voting table assemblies in a stacked configuration.

13. A multi-configuration voting booth, comprising:

a voting tabletop assembly having a tabletop top surface, a tabletop bottom surface, and a perimeter wall, the perimeter wall extending downward from a peripheral edge of the tabletop bottom surface, the perimeter wall and tabletop bottom surface collectively defining a bottom cavity;

a plurality of support leg assemblies attached to the voting tabletop assembly, wherein the legs are configurable between a stored configuration locating each entire collapsed leg within the bottom cavity, a standard deployed configuration positioning the support leg assemblies at a first predetermined span and a first predetermined vertical dimension, and a handicapped configuration positioning the support leg assemblies at a second predetermined span and a second predetermined vertical dimension, wherein the second span is greater than the first span, and the first vertical dimension is greater than the second vertical dimension;

each support leg assembly comprising an operationally attached leg member, wherein said operationally attached leg member is pivotally attached to a fixed member leg assembly pivot support bracket extending into the voting table bottom cavity from a voting tabletop underside surface;

a rotational interface provided between a pivotally attached leg member located at an attachment end of the support leg assembly and a horizontally telescoping leg segment of the support leg assembly, wherein the rotational interface rotates the support leg assembly respective to the pivotally attached leg member about the longitudinal axis of the respective support leg assembly;

a privacy panel assembly including a rear panel defined by a lower edge, an upper edge, a first vertical edge, and a second vertical edge; a first side panel attached to the first rear panel vertical edge and a second side panel attached to the second rear panel vertical edge; and an interface retaining the privacy panel assembly and the voting tabletop assembly together, wherein the privacy panel assembly is configured extending upwards from a position proximate three sides of a perimeter of the voting tabletop assembly.

14. A multi-configuration voting booth as recited in claim 13, further comprising a pivotal interface provided between the privacy panel assembly and the voting tabletop assembly together.

15. A multi-configuration voting booth as recited in claim 13, further comprising a pivotal interface provided between each support leg assembly and the voting tabletop assembly, wherein the pivotal interface rotates each support leg assembly about an axis perpendicular to the longitudinal axis of the respective support leg assembly.

16. A multi-configuration voting booth as recited in claim 13, further comprising at least one leg storage retention feature for retaining each support leg assembly in a storage configuration.

17. A multi-configuration voting booth as recited in claim 13, further comprising at least one leg deployment retention feature for retaining each support leg assembly in a deployed configuration.

18. A multi-configuration voting booth as recited in claim 13, further comprising at least one coupling interface for retaining a plurality of voting table assemblies in a stacked configuration.

* * * * *